US011830646B2

(12) United States Patent
Suzuki et al.

(10) Patent No.: US 11,830,646 B2
(45) Date of Patent: Nov. 28, 2023

(54) R-T-B BASED PERMANENT MAGNET

(71) Applicant: TDK Corporation, Tokyo (JP)

(72) Inventors: Kenichi Suzuki, Tokyo (JP); Lihua Liu, Tokyo (JP)

(73) Assignee: TDK Corporation, Tokyo (JP)

( * ) Notice: Subject to any disclaimer, the term of this patent is extended or adjusted under 35 U.S.C. 154(b) by 158 days.

(21) Appl. No.: 17/554,336

(22) Filed: Dec. 17, 2021

(65) Prior Publication Data

US 2022/0199300 A1 Jun. 23, 2022

(30) Foreign Application Priority Data

Dec. 22, 2020 (JP) ..... 2020-212696

(51) Int. Cl.
*H01F 1/057* (2006.01)
*C22C 30/00* (2006.01)
*B22F 3/14* (2006.01)

(52) U.S. Cl.
CPC ..... *H01F 1/0576* (2013.01); *B22F 3/14* (2013.01); *C22C 30/00* (2013.01); *B22F 2301/355* (2013.01); *C22C 2202/02* (2013.01)

(58) Field of Classification Search
None
See application file for complete search history.

(56) References Cited

U.S. PATENT DOCUMENTS 5,788,782 A * 8/1998 Kaneko ..... C22C 1/0441 148/101
2007/0199623 A1* 8/2007 Suzuki ..... H01F 41/22 428/692.1
2010/0172783 A1 7/2010 Hioki et al.
2013/0321112 A1 12/2013 Miyamoto et al.
2016/0055969 A1 2/2016 Haga et al.
2016/0099104 A1 4/2016 Haga et al.
2016/0336112 A1 11/2016 Kano et al.

FOREIGN PATENT DOCUMENTS

JP 2011-042837 A 3/2011
JP 2012-174986 A 9/2012
JP 2015-126213 A 7/2015
JP 2016-046440 A 4/2016
JP 2016-076549 A 5/2016
JP 2017-050396 A 3/2017

* cited by examiner

*Primary Examiner* — Brian D Walck
(74) *Attorney, Agent, or Firm* — Faegre Drinker Biddle & Reath LLP

(57) ABSTRACT

An R-T-B based permanent magnet includes a rare earth element R, a transition metal element T, and B. The permanent magnet includes at least Nd as R. The permanent magnet includes at least Fe as T. The permanent magnet contains main phase grains and R-rich phases. The main phase grains include at least R, T, and B. The R-rich phases include at least R. The main phase grains observed in a cross section of the permanent magnet are flat. The cross section is parallel to an easy magnetization axis direction of the permanent magnet. Each of the R-rich phases is located between the main phase grains. An average value of intervals between the R-rich phases in the easy magnetization axis direction is from 5 μm to a width of the permanent magnet in the easy magnetization axis direction.

8 Claims, 5 Drawing Sheets

R-T-B BASED PERMANENT MAGNET

TECHNICAL FIELD

The present disclosure relates to an R-T-B based permanent magnet.

BACKGROUND

An R-T-B based permanent magnet includes rare earth elements R (Nd and the like), transition metal elements T (Fe and the like), and boron (B). The R-T-B based permanent magnet has a good magnetic property, and is widely used. As the R-T-B based permanent magnet, there are a sintered magnet produced by a powder metallurgy method, and a hot deformed magnet produced by a hot plastic deforming method (refer to Japanese Unexamined Patent Publication No. 2017-50396, Japanese Unexamined Patent Publication No. 2011-42837, Japanese Unexamined Patent Publication No. 2012-174986, Japanese Unexamined Patent Publication No. 2015-126213, Japanese Unexamined Patent Publication No. 2016-46440, and Japanese Unexamined Patent Publication No. 2016-76549). An alloy ribbon that is a raw material of the hot deformed magnet is obtained by a super-rapid cooling and solidification method (rapid-solidification method). In the super-rapid cooling and solidification method, a molten metal of an R-T-B based alloy is rapidly cooled on a surface of a cooled roll. As a result, the molten metal is solidified to form an alloy ribbons. The alloy ribbons obtained by the super-rapid cooling and solidification method contain fine crystals of the alloy (and an amorphous alloy). Therefore, crystal grains (main phase grains) composing the hot deformed magnet are finer than those of the sintered magnet. As shown in the Kronmuller Formular, it is known that the finer the crystal grain size of the R-T-B based permanent magnet is, the more the coercivity (HcJ) increases. Therefore, the hot deformed magnet is expected to have a higher coercivity than that of the sintered magnet. However, the coercivity of the hot deformed magnet in the related art is equivalent to the coercivity of the sintered magnet having the same composition, and a high coercivity anticipated from a fine crystal grain size is not obtained.

SUMMARY

Therefore, the present inventors have investigated and examined a cause why a high coercivity corresponding to a fine crystal grain size is not obtained in an R-T-B based permanent magnet (for example, hot deformed magnet) in the related art. As a result, the present inventors have found that a distribution of R-rich phases in a cross section of the R-T-B based permanent magnet substantially parallel to an easy magnetization axis direction affects a coercivity. Further, the present inventors have found a method for obtaining the R-T-B based permanent magnet having a high coercivity by controlling the distribution of the R-rich phases in the cross section.

An object of one aspect of the present invention is to provide an R-T-B based permanent magnet having a high coercivity.

According to one aspect of the present invention, there is provided an R-T-B based permanent magnet including: a rare earth element R; a transition metal element T; and B. The R-T-B based permanent magnet includes at least Nd as R. The R-T-B based permanent magnet includes at least Fe as T. The R-T-B based permanent magnet contains a plurality of main phase grains and a plurality of R-rich phases. The plurality of main phase grains include at least R, T, and B. The plurality of R-rich phases include at least R. The main phase grains observed in a cross section of the R-T-B based permanent magnet are flat (platelet). The cross section is substantially parallel to an easy magnetization axis direction of the R-T-B based permanent magnet. Each of the plurality of R-rich phases is located between the plurality of main phase grains. In other words, an R-rich phase (each one of R-rich phases) is located between at least two main phase grains. An average value of intervals between the plurality of R-rich phases in the easy magnetization axis direction is from 5 μm to a width of the R-T-B based permanent magnet in the easy magnetization axis direction.

An average value of lengths of short axes of the plurality of main phase grains observed in the cross section may be from 20 nm to 200 nm.

A content of R in the R-T-B based permanent magnet may be from 28 mass % to 33 mass %, and a content of B in the R-T-B based permanent magnet may be from 0.8 mass % to 1.1 mass %.

At least a part of the plurality of R-rich phases may include R-oxides.

The plurality of main phase grains that are flat (platelet) may be stacked along the easy magnetization axis direction.

The R-T-B based permanent magnet may be a hot deformed magnet.

A concentration of R in at least a part of the plurality of R-rich phases may be higher than an average value of a concentration of R in the cross section, and a unit of the concentration of R may be atom %.

A concentration of R in at least a part of the plurality of R-rich phases may be higher than a concentration of R in the plurality of main phase grains, and a unit of the concentration of R may be atom %.

According to one aspect of the present invention, there is provided the R-T-B based permanent magnet having a high coercivity.

DETAILED DESCRIPTION

Figure 1A:
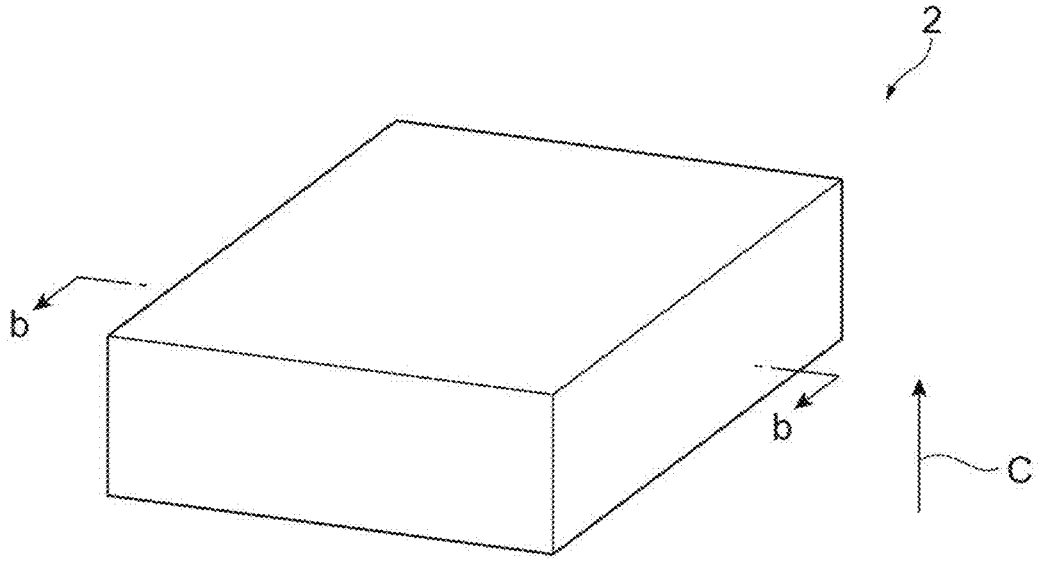
FIG. 1A is a schematic perspective view of an R-T-B based permanent magnet according to one embodiment of the present invention.

Hereinafter, a preferable embodiment of the present invention will be described with reference to the drawings. In the drawings, equivalent constituents are denoted by equivalent reference signs. The present invention is not limited to the following embodiment. A "permanent magnet" described below means an R-T-B based permanent magnet. The unit of a concentration of each element in the permanent magnet described below is atom %.

(Permanent Magnet)

A permanent magnet according to the present embodiment includes at least a rare earth element (R), a transition metal element (T), and boron (B). The permanent magnet according to the present embodiment is a hot deformed magnet. However, the permanent magnet according to the present invention may be a sintered magnet.

The permanent magnet includes at least neodymium (Nd) as the rare earth element R. The permanent magnet may further include another rare earth element R in addition to Nd. Another rare earth element R included in the permanent magnet may be at least one selected from a group consisting of scandium (Sc), yttrium (Y), lantern (La), cerium (Ce), praseodymium (Pr), samarium (Sin), europium (Eu), gadolinium (Gd), terbium (Tb), dysprosium (Dy), holmium (Ho), erbium (Er), thulium (Tin), ytterbium (Yb), and lutetium (Lu).

The permanent magnet includes at least iron (Fe) as the transition metal element T. The permanent magnet may include only Fe as the transition metal element T. The permanent magnet may include both Fe and cobalt (Co) as the transition metal element T.

Figure 1B:
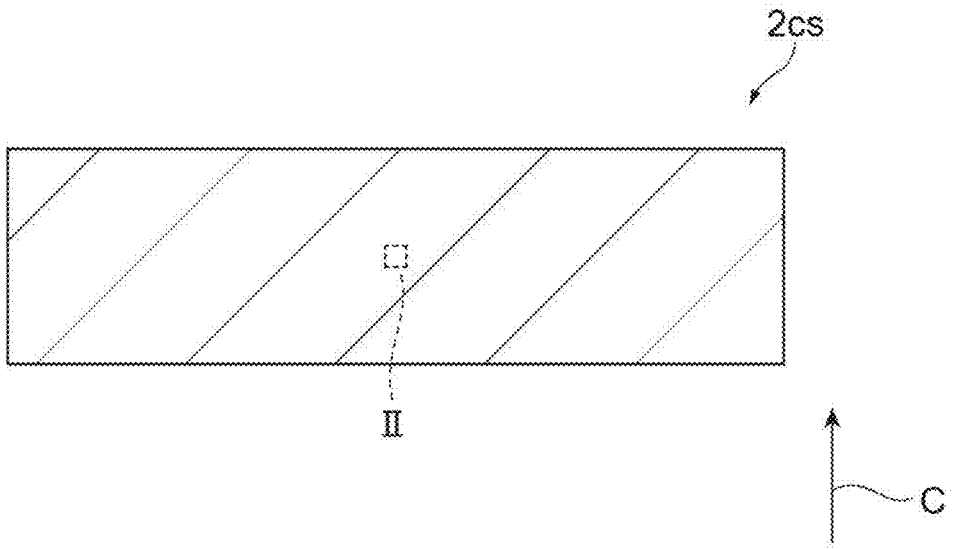
FIG. 1B is a schematic view (view in a direction of arrow b-b) of a cross section of the R-T-B based permanent magnet illustrated in FIG. 1A.

FIG. 1A is a perspective view of a permanent magnet 2 according to the present embodiment. FIG. 1B is a schematic view of a cross section 2*cs* of the permanent magnet 2, and the cross section 2*cs* of the permanent magnet 2 is substantially parallel to an easy magnetization axis direction C of the permanent magnet 2. The easy magnetization axis direction C is a direction parallel to a straight line connecting a pair of magnetic poles of the permanent magnet 2. That is, the easy magnetization axis direction C is a direction from an S (South) pole of the permanent magnet 2 toward an N (North) pole of the permanent magnet 2. The easy magnetization axis direction C may be specified based on a measurement of a magnetic flux distribution of the permanent magnet 2. The easy magnetization axis direction C may be specified based on a measurement of a magnetic flux distribution of an analysis sample separated from the permanent magnet 2.

The permanent magnet 2 according to the present embodiment is a rectangular parallelepiped (plate). However, the shape of the permanent magnet 2 is not limited to a rectangular parallelepiped. For example, the shape of the permanent magnet 2 may be a cube, a polygonal prism, an arc segment, an annular sector, a sphere, a disk, a column, a cylinder, or a ring. The shape of the cross section 2*cs* of the permanent magnet 2 may be, for example, a polygon, an arc (circular chord), a bow shape, an arch shape, a C-shape, or a circle.

Figure 2:
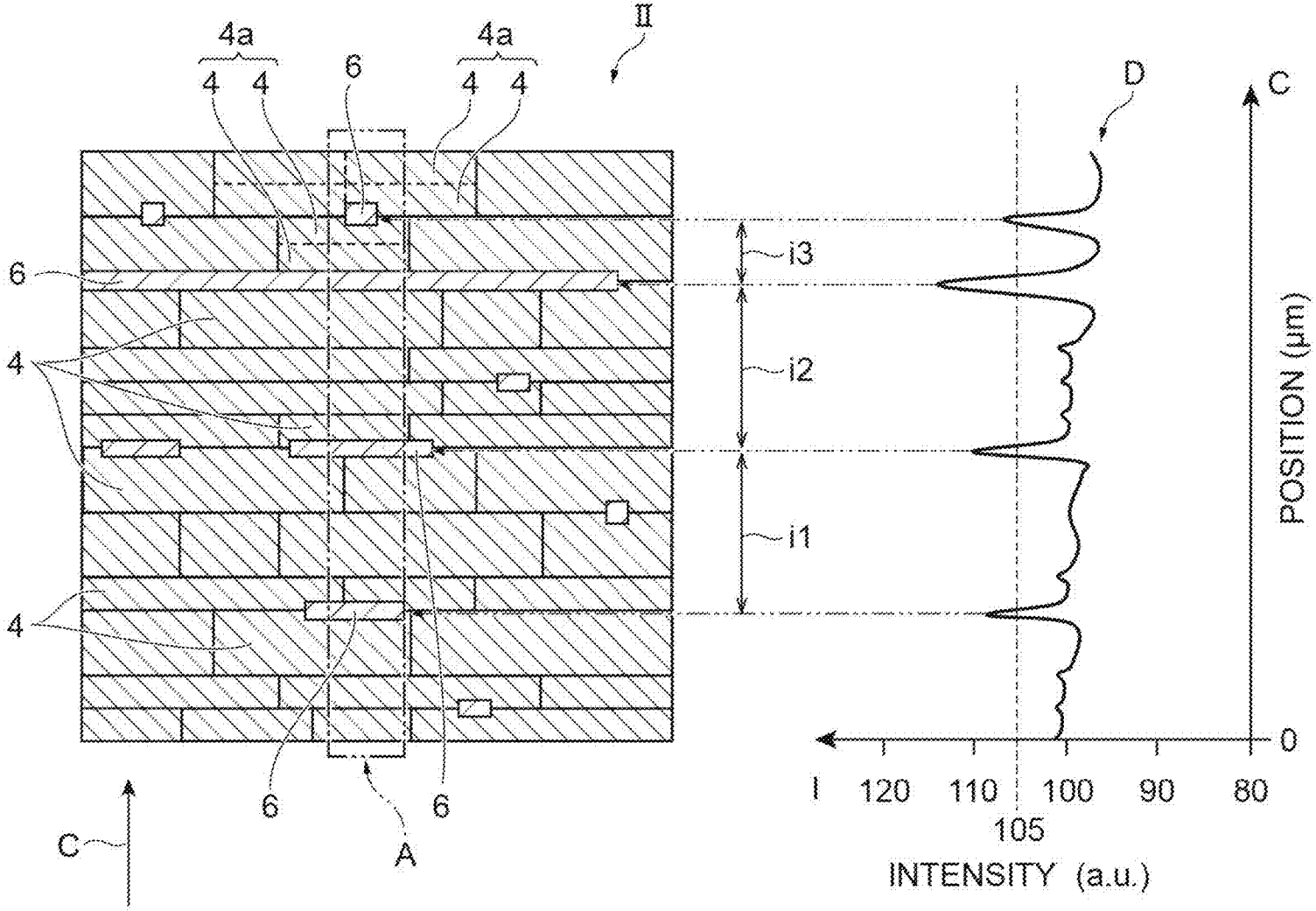
FIG. 2 is an enlarged view of a part (region II) of the cross section illustrated in FIG. 1B, and illustrates a luminance distribution of a backscattered electron image of the region II.
Figure 3A:
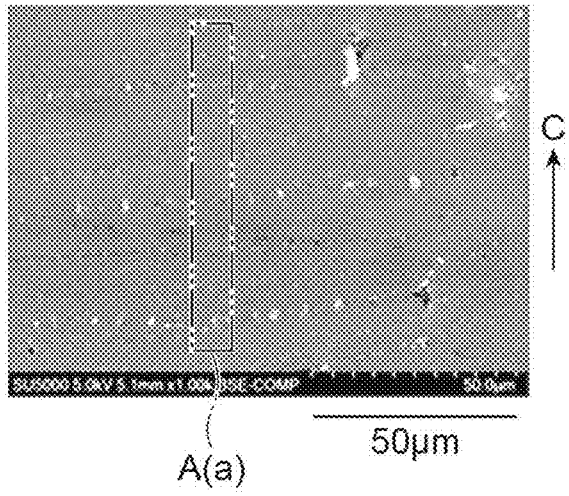
FIG. 3A, FIG. 3B, FIG. 3C, FIG. 3D and FIG. 3E illustrate backscattered electron images of a cross section of an R-T-B based permanent magnet of Example 4.
Figure 3B:
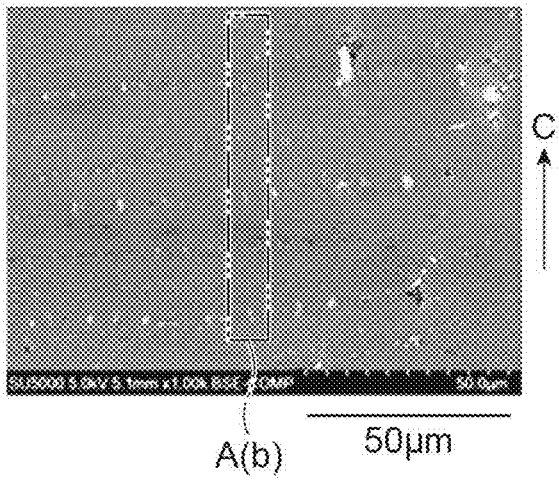
Figure 3C:
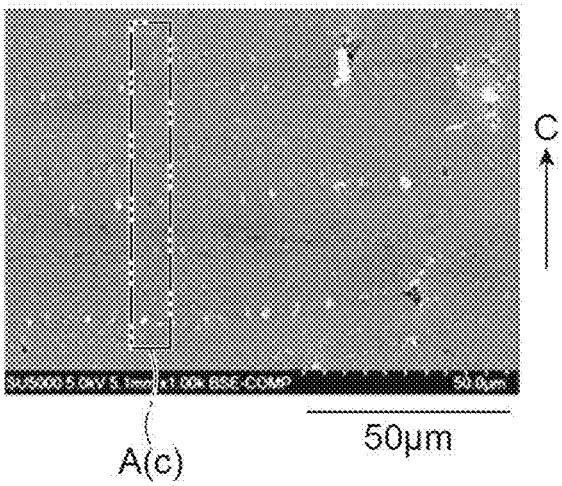
Figure 3D:
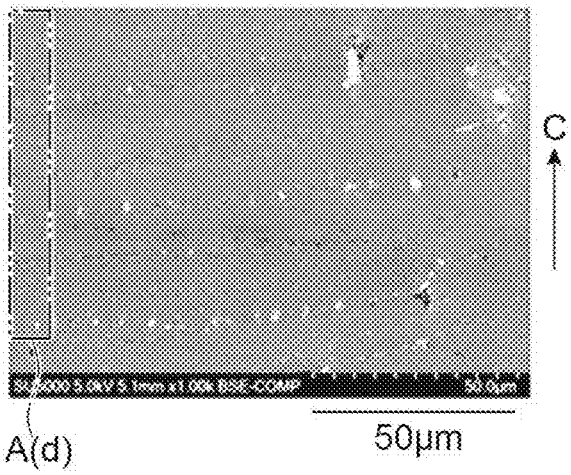
Figure 3E:
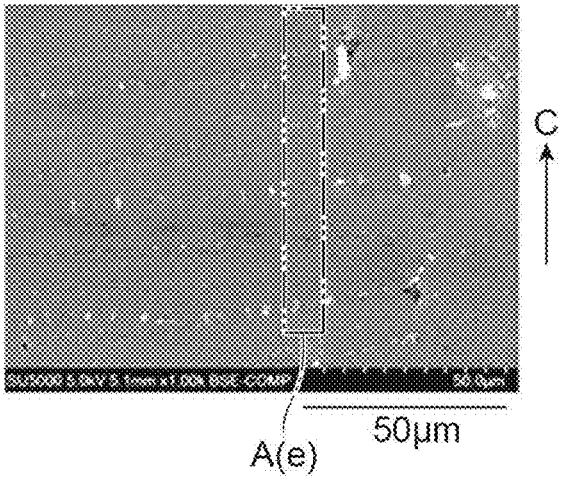
Figure 4A:
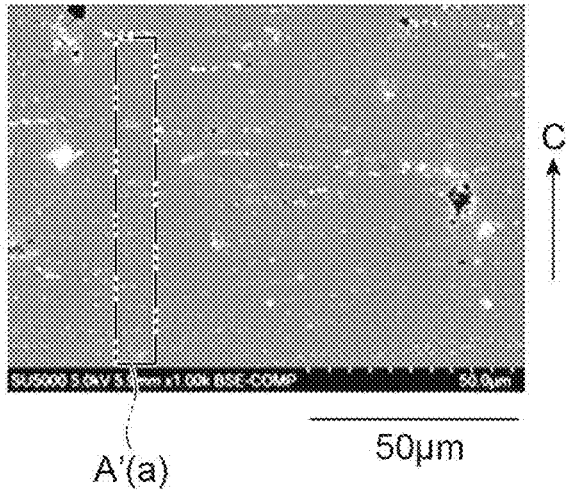
FIG. 4A, FIG. 4B, FIG. 4C, FIG. 4D and FIG. 4E illustrate backscattered electron images of a cross section of an R-T-B based permanent magnet of Comparative Example 1.
Figure 4B:
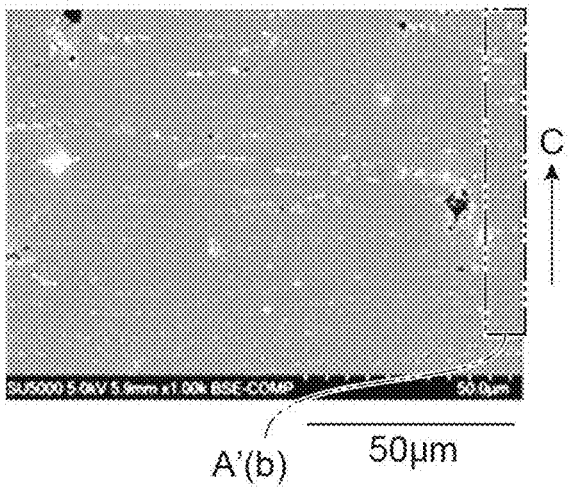
Figure 4C:
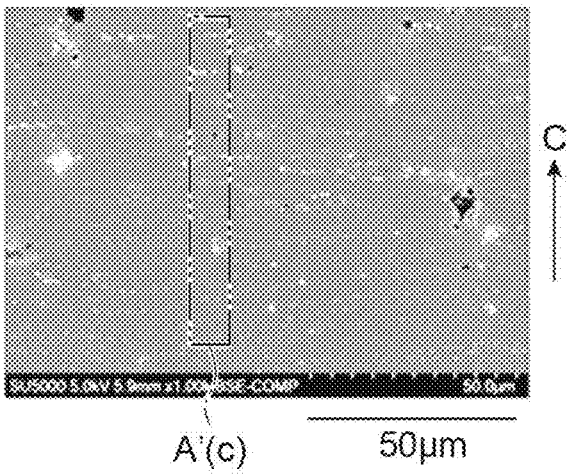
Figure 4D:
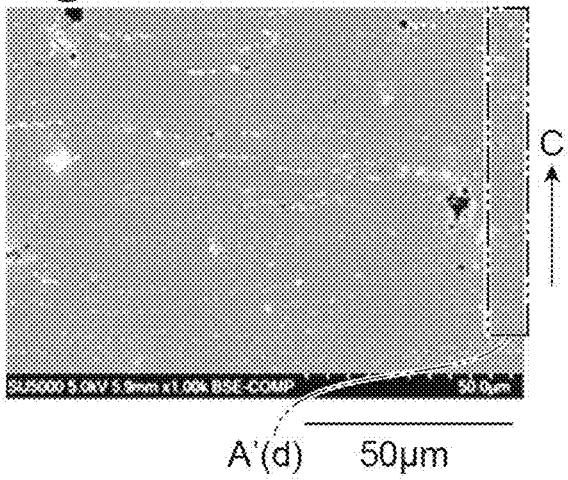
Figure 4E:
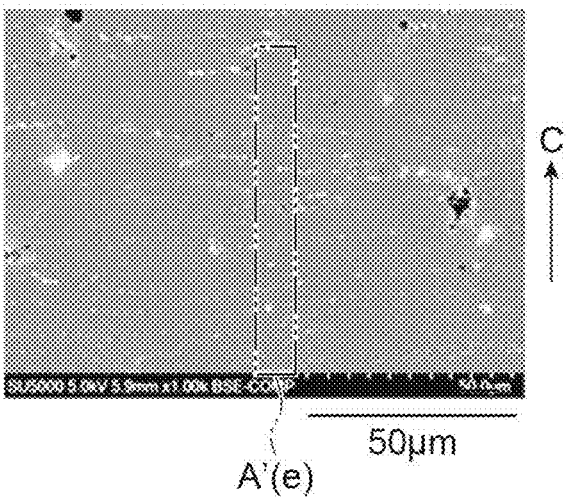

FIG. 2 is an enlarged view of a part (region II) of the cross section 2*cs* illustrated in FIG. 1B. As illustrated in FIG. 2, the permanent magnet 2 contains a plurality of main phase grains 4 and a plurality of R-rich phases 6. The R-rich phase 6 is located between a plurality of the main phase grains 4. The R-rich phase 6 may be one of grain boundary phases contained in a grain boundary between a plurality of the main phase grains 4. The grain boundary in which the R-rich phase 6 is contained may be a grain boundary multiple junction surrounded by three or more main phase grains 4, or may be a two-grain boundary between two main phase grains 4. A total volume ratio of the main phase grains 4 in the permanent magnet 2 is not particularly limited, and may be, for example, 80 volume % or more and less than 100 volume %, 90 volume % or more and less than 100 volume %, or 95 volume % or more and less than 100 volume %.

The main phase grain 4 includes at least Nd, T, and B. The main phase grain 4 may be rephrased as one crystal grain (namely, primary grain). The main phase grain 4 contains one or more crystals (single crystal or polycrystal) of $R_2T_{14}B$. The main phase grain 4 may consist of one or more crystals of $R_2T_{14}B$. A crystal of $R_2T_{14}B$ may be tetragonal. That is, crystal axes of $R_2T_{14}B$ are an a-axis, a b-axis, and a c-axis, and the a-axis, the b-axis, and the c-axis are orthogonal to each other. A lattice constant of $R_2T_{14}B$ in an a-axis direction may be equal to a lattice constant of $R_2T_{14}B$ in a b-axis direction, and a lattice constant of $R_2T_{14}B$ in a c-axis direction may be different from the lattice constants of $R_2T_{14}B$ in the a-axis direction and the b-axis direction. The c-axis direction of $R_2T_{14}B$ may be substantially parallel to the easy magnetization axis direction C of the permanent magnet 2.

The main phase grain 4 may include other element in addition to Nd, T, and B. For example, $R_2T_{14}B$ composing the main phase grain 4 may be expressed by $(Nd_{1-x}Pr_x)_2(Fe_{1-y}Co_y)_{14}B$. x may be 0 or more and less than 1. y may be 0 or more and less than 1. The main phase grain 4 may include a heavy rare earth element such as Tb and Dy as R in addition to a light rare earth element. A part of B in $R_2T_{14}B$ may be replaced with other element such as carbon (C). A composition in the main phase grain 4 may be uniform. The composition in the main phase grain 4 may be uneven. For example, a concentration distribution of each of R, T, and B in the main phase grain 4 may have a gradient.

The main phase grain 4 may be composed of a surface portion and a central portion covered with the surface portion. The surface portion may be rephrased as a shell, and the central portion may be rephrased as a core. The surface portion of the main phase grain 4 may include at least one heavy rare earth element of Tb and Dy. The surface portion of each of all the main phase grains 4 may include at least one heavy rare earth element of Tb and Dy. The surface portions of a part of main phase grains 4 among all the main phase grains 4 may include at least one heavy rare earth element of Tb and Dy. When the surface portion includes a heavy rare earth element, an anisotropic magnetic field is likely to increase locally in the vicinity of a grain boundary, and a nucleus of magnetization reversal is unlikely to be generated in the vicinity of the grain boundary. As a result, the coercivity of the permanent magnet 2 increases at high temperature (for example, 100 to 200° C.). A total concentration of heavy rare earth elements in the surface portion may be higher than a total concentration of the heavy rare earth elements in the central portion so that the residual magnetic flux density (Br) and the coercivity of the permanent magnet 2 can be likely to be compatible.

The R-rich phase 6 includes at least R. For example, the R-rich phase 6 may include Nd as R. The R-rich phase 6 may further contain one or more other rare earth elements as R in addition to Nd. The R-rich phase 6 may further include one or more elements other than R in addition to R. At least a part of the R-rich phases 6 may include R-oxides. All the R-rich phases 6 may include R-oxides. For example, the R-oxides may be Nd-oxides. An oxidized surface of the main phase grain 4 may be the R-rich phase 6. The R-rich phase 6 may consist of only the R-oxides. The present inventors consider that the R-rich phase 6 including the R-oxides is formed by the oxidation of R located in the vicinity of a surface of an alloy ribbon or alloy powder (precursor of the main phase grain 4) in a production process of the permanent magnet 2 (particularly, each transport step described later). The R-rich phase 6 may include at least one component selected from a group consisting of oxide, metal, alloy, and intermetallic compound.

A concentration of R in at least a part of the R-rich phases 6 may be higher than an average value of a concentration of R in the cross section 2*cs*. The concentration of R in at least a part of the R-rich phases 6 may be higher than an average value of a concentration of R in the main phase grains 4. When the permanent magnet 2 includes a plurality of Rs, a concentration of R may be a total concentration of the plurality of Rs.

As illustrated in FIG. 2, each of the main phase grains 4 observed in the cross section 2*cs* is flat (platelet shape). In other words, each of the main phase grains 4 observed in the cross section 2*cs* may have a plate shape. The plurality of main phase grains 4 that are flat may be stacked along the easy magnetization axis direction C. The permanent magnet 2 may further contain a secondary grain 4*a* composed of a plurality of the main phase grains 4 bounded each other. The permanent magnet 2 may contain a plurality of the secondary grains 4*a*. At least a part of the R-rich phases 6 may be located at grain boundaries between a plurality of the secondary grains 4*a*. An oxidized surface of the secondary grain 4*a* may be the R-rich phase 6. At least a part of the R-rich phases 6 may be a layer extending in a direction substantially perpendicular to the easy magnetization axis direction C. At least a part of the R-rich phases 6 may be dotted (scattered) in the cross section 2*cs*. For example, at least a part of the R-rich phases 6 may be dotted (scattered) in the cross section 2*cs* along the direction substantially perpendicular to the easy magnetization axis direction C. At least a part of the R-rich phases 6 may be located between the plurality of main phase grains 4 that are flat and stacked along the easy magnetization axis direction C.

An average value $i_{AVE}$ of intervals between the R-rich phases 6 in the easy magnetization axis direction C is from 5 μm to a width of the permanent magnet 2 in the easy magnetization axis direction C. The average value $i_{AVE}$ of the intervals between the R-rich phases 6 in the easy magnetization axis direction C may be from 5 μm to 50 μm, from 5 μm to 10 μm, from 5.414 μm to 9.217 μm, or from 7.9 μm to 9.217 μm. When the average value $i_{AVE}$ of the intervals between the R-rich phases 6 is within the above range, the permanent magnet 2 can have a high coercivity at room temperature and high temperature. The average value $i_{AVE}$ of the intervals between the R-rich phases 6 in the easy magnetization axis direction C may be substantially equal to an average value of a sum of widths of one or more main phase grains 4 located between a pair of the R-rich phases 6 in the easy magnetization axis direction C. The average value of the intervals between the R-rich phases 6 in the easy magnetization axis direction C is measured by the following method.

A backscattered electron image of a part (region II) of the cross section 2*cs* of the permanent magnet 2 is photographed by a scanning electron microscope (SEM). The magnification of the backscattered electron image may be, for example, 1,000 times. As illustrated in FIG. 2, an arbitrary rectangular measurement region A in which a plurality of portions (6) having a relatively high luminance are arranged along the easy magnetization axis direction C is selected from the backscattered electron image. A width of the measurement region A in the easy magnetization axis direction C is more than a width of the measurement region A in a direction perpendicular to the easy magnetization axis direction C. For example, the width of the measurement region A in the easy magnetization axis direction C may be 80 μm, and the width of the measurement region A in the direction perpendicular to the easy magnetization axis direction C may be 10 μm. The measurement region A is scanned along the easy magnetization axis direction C with an electron beam, and luminances of measurement points in the measurement region A are continuously measured along the easy magnetization axis direction C. As a result, a luminance distribution D of the measurement region A along the easy magnetization axis direction C is obtained. An interval between the measurement points may be, for example, 1 μm or less. The luminance is an intensity (INTENSITY in FIG. 2) of a backscattered electron beam at each measurement point. The unit of the luminance is an arbitrary unit (a.u.). The more the atomic weight of an element is, the higher the luminance of a measurement point at which the element exists is. The higher the concentration of an element having a large atomic weight is at a measurement point, the higher the luminance of the measurement point is. Among all elements included in the permanent magnet 2, an atomic weight of R is relatively large. Therefore, a peak in the luminance distribution D indicates the existence of the R-rich phase. A moving average $I_{AVE}$ of luminance is calculated from the luminance of an arbitrary measurement point X in the measurement region A, the luminance of each of five measurement points measured immediately before the measurement of the luminance of the measurement point X, and the luminance of each of the five measurement points measured immediately after the measurement of the luminance of the measurement point X. That is, the moving average $I_{AVE}$ of luminance is calculated from the luminances of a total of 11 measurement points including the measurement point X. When a value obtained by subtracting $I_{AVE}$ from the luminance of the measurement point X is 5% or more of $I_{AVE}$, the measurement point X is the R-rich phase 6. That is, when the luminance of the measurement point X is 105% or more of $I_{AVE}$, the position (POSITION in FIG. 2) of the measurement point X (peak of the luminance at the measurement point X) is the position of the R-rich phase 6. A distance between two R-rich phases 6 adjacent to each other in the easy magnetization axis direction C is an interval between the R-rich phases 6. An average value of the intervals between the R-rich phases 6 in the measurement region A is calculated based on the above assumptions. For example, four R-rich phases 6 exist in the measurement region A illustrated in FIG. 2, and i1, i2, and i3 are measured as intervals between the R-rich phases 6. An average value of the intervals between the R-rich phases 6 in the measurement region A illustrated in FIG. 2 is (i1+i2+i3)/3.

A plurality of different measurement regions A are selected from the backscattered electron image, and an average value of intervals between the R-rich phases 6 in each of the measurement regions A is measured by the above method. For example, five measurement regions A may be selected from the backscattered electron image. The average values of the intervals between the R-rich phases 6 in the plurality of measurement regions A are further averaged to obtain the above-described average value $i_{AVE}$. An average line (100% line) of the luminance distribution D in FIG. 2 may be a curved line.

The R-rich phase 6 is a cause of a decrease in the coercivity of the permanent magnet 2. However, the permanent magnet 2 according to the present embodiment can have a higher coercivity than that of a permanent magnet having the same composition in the related art. In other words, in the permanent magnet 2 according to the present embodiment, a decrease in coercivity caused by the R-rich phases 6 is suppressed. A mechanism that suppresses a decrease in coercivity caused by the R-rich phases 6 will be described below. However, the technical scope of the present invention is not limited by the following mechanism.

Since a coercivity mechanism of the R-T-B based permanent magnet is a nucleation type, a reverse magnetic domain is generated to become a nucleus of magnetization reversal. That is, the generation of the reverse magnetic domain is a cause of a decrease in coercivity. The reverse magnetic domain is generated from a place in which a local demagnetizing field is large. The place in which the local demagnetizing field is large is a void, a surface of a main phase grain, and a heterogeneous phase.

<Void>

Since both a sintered magnet and a hot deformed magnet are densified to a substantially true density, the void is unlikely to exist.

<Surface of Main Phase Grain>

Since the shapes of main phase grains composing a sintered magnet reflect the shape of alloy powder obtained by airflow pulverization, the shapes of the main phase grains composing the sintered magnet are heterogeneous (strained). Since surfaces of the heterogeneous main phase grains are not smooth, the surfaces are likely to become starting points for the generation of reverse magnetic domains.

On the other hand, main phase grains composing a hot deformed magnet are plate-shaped crystals that have undergone anisotropic crystal growth from ultrafine crystal grains. As a result, the shapes of the main phase grains composing the hot deformed magnet are relatively uniform, and surfaces of the main phase grains composing the hot deformed magnet are smoother than the surfaces of the main phase grains composing the sintered magnet. Therefore, in the surfaces of the main phase grains composing the hot deformed magnet, a local demagnetizing field is small, and the reverse magnetic domain is unlikely to be generated. As a result, the hot deformed magnet is likely to have a high coercivity.

<Heterogeneous Phase>

A sintered magnet is densified by a sintering step. In the sintering step, a green compact formed from alloy powder is sintered. In a sintering process, surfaces of the alloy powder become liquid phases, and the liquid phases filling gaps between alloy powder particles become grain boundary phases (R-rich phases), so that a dense sintered body is obtained. A two-grain boundary phase is useful for magnetic decoupling that prevents a movement of a magnetic domain wall between the main phase grains. Extra grain boundary phase components other than the two-grain boundary phase are discharged from a surface of the sintered body, but the amount thereof is small, and most thereof segregates at grain boundary multiple junctions. The grain boundary phases that have segregated at the grain boundary multiple junctions are not useful. The reason is that the grain boundary phases that have segregated at the grain boundary multiple junctions are heterogeneous phases and become starting points at which reverse magnetic domains are generated. However, as described above, since the sintered magnet requires liquid phases for densification, the segregation of the grain boundary phases (R-rich phases) at the grain boundary multiple junctions is inevitable.

On the other hand, the densification of a hot deformed magnet depends on temperature and pressure of hot pressing and hot plastic deforming. However, the densification of the hot deformed magnet does not require as many grain boundary phases as in the sintered magnet. When plate-shaped main phase grains that have grown anisotropically are rearranged by hot plastic deforming, the grain boundary phases that are liquid phases are useful for the lubricity (grain boundary sliding) of the main phase grains. However, the amount of liquid phases required for the lubricity of the main phase grains may be less than the amount of liquid phases required for the densification of the sintered magnet. For this reason, the segregation of the R-rich phases at grain boundary multiple junctions in the hot deformed magnet is less than in the sintered magnet. That is, heterogeneous phases in the hot deformed magnet are less than in the sintered magnet. Therefore, the hot deformed magnet is likely to have a high coercivity.

However, the hot deformed magnet inevitably contains the R-rich phases. Reverse magnetic domains are likely to be generated in the R-rich phases, and the R-rich phases become nuclei of magnetization reversal. The magnetization reversal of the main phase grains makes progress from the nuclei of magnetization reversal, and the coercivity of the permanent magnet decreases.

As described above, in the sintered magnet and the hot deformed magnet of the related art, there occurs a decrease in coercivity caused by the R-rich phases. In contrast, in the case of the permanent magnet 2 according to the present embodiment, the interval between the R-rich phases 6 in the easy magnetization axis direction C is relatively large. That is, in the case of the permanent magnet 2 according to the present embodiment, the average value $i_{AVE}$ of the intervals between the R-rich phases 6 in the easy magnetization axis direction C is 5 μm or more. As a result, the frequency of generation of the reverse magnetic domains in the easy magnetization axis direction C is reduced, and a decrease in coercivity caused by the R-rich phases 6 is suppressed. The more a width of each of the main phase grains 4 (or a thickness of an alloy ribbon described later) in the easy magnetization axis direction C is, the less a specific surface area of each of the main phase grains 4 is. The less the specific surface area of each of the main phase grains 4 is, the oxidation of each of the main phase grains 4 is more easily suppressed and the R-rich phases caused by oxidation are more unlikely to be formed. As a result, the average value $i_{AVE}$ of the intervals between the R-rich phases 6 in the easy magnetization axis direction C is likely to increase, and the coercivity of the permanent magnet 2 is likely to increase. On the other hand, the more the width of each of the main phase grains 4 (or a thickness of an alloy ribbon described later) in the easy magnetization axis direction C is, the more grain sizes of the main phase grains 4 (crystal grain sizes) are. As the grain sizes of the main phase grains 4 (crystal grain sizes) increase, the coercivity of the permanent magnet 2 is likely to decrease. However, according to the present embodiment, the oxidation of alloy ribbons and alloy powder in each transport step described later is suppressed, and the formation of the R-rich phases is suppressed. Therefore, according to the present embodiment, both an increase in coercivity caused by an increase in the average value $i_{AVE}$ of the intervals between the R-rich phases 6 and an increase in coercivity caused by a reduction in the grain sizes of the main phase grains 4 (crystal grain sizes) can be compatible An average value of lengths of short axes of the main phase grains 4 (primary grains) observed in the cross section 2*cs* is, for example, from 20 nm to 200 nm. When the average value of the lengths of the short axes of the main phase grains 4 is within the above range, the average value $i_{AVE}$ of the intervals between the R-rich phases 6 in the easy magnetization axis direction C is easily controlled within the above range. The more the average value of the lengths of the short axes of the main phase grains 4 is, the more the average value $i_{AVE}$ of the intervals between the R-rich phases 6 in the easy magnetization axis direction C tends to be. The less the average value of the lengths of the short axes of the main phase grains 4 is, the higher the coercivity of the permanent magnet 2 tends to be. An average value of lengths of long axes of the main phase grains 4 (primary grains) observed in the cross section 2*cs* is, for example, from 100 nm to 1,000 nm. The short axis of each of the main phase grains 4 observed in the cross section 2*cs* may be substantially parallel to the easy magnetization axis direction C. The long axis of each of the main phase grains 4 may be substantially perpendicular to the easy magnetization axis direction C. The shape of the main phase grain 4 in the cross section 2*cs* is not limited to a rectangle. The shape of the main phase grain 4 in the cross section 2*cs* may be strained. The shapes of the main phase grains 4 in the cross section 2*cs* may not be uniform. When the shape of the main phase grain 4 in the cross section 2*cs* is strained, the shape of the main phase grain 4 may be approximated by a quadrilateral having a minimum area among quadrilaterals circumscribing the main phase grain 4. The quadrilateral may be a rectangle. A length of a short side of the quadrilateral may be regarded as the length of the short axis of the main phase grain 4, and a length of a long side of the quadrilateral may be regarded as the length of the long axis of the main phase grain 4. The average value of the lengths of the short axes of the main phase grains 4 may be calculated from measured values of the lengths of the short axes of all the main phase grains 4 existing in a backscattered electron image of the cross section 2*cs* photographed by a scanning electron microscope (SEM). The average value of the lengths of the long axes of the main phase grains 4 may also be calculated from measured values of the lengths of the long axes of all the main phase grains 4 existing in the backscattered electron image. However, the dimensions of the main phase grains 4 protruding from the backscattered electron image are excluded from the calculation of the average value. A maximum value of the dimensions of the backscattered electron image used for measurement of the lengths of each of the short axes and the long axes of the main phase grains 4 may be, for example, 120 μm in length×80 μm in width or 88 μm in length×126 μm in width. A plurality of representative locations in a backscattered electron image photographed at a low magnification may be selected, and a backscattered electron image of each location may be photographed at a high magnification. Then, an average value of each of long axes and short axes may be calculated from lengths of the long axes and the short axes of all the main phase grains 4 measured in the backscattered electron image of the high magnification. Commercially available image analysis software may be used to specify the shape (contour line) of the main phase grain 4 and to measure the dimensions of the main phase grain 4 (quadrilateral circumscribing the main phase grain 4).

A width of each of the R-rich phases 6 in the easy magnetization axis direction C may be, for example, from 100 nm to 1,000 nm. When the width of the R-rich phase 6 in the easy magnetization axis direction C is within the above range, the magnetization reversal of the main phase grains 4 is easily suppressed, and the permanent magnet 2 is likely to have a high coercivity. The width of the R-rich phase 6 in the easy magnetization axis direction C may be less than the length of the short axis of the main phase grain 4 (primary grain). The width of the R-rich phase 6 in the easy magnetization axis direction C may be less than the length of the short axis of the secondary grain 4*a*.

The width of the permanent magnet 2 in the easy magnetization axis direction C is more in order of magnitude than a lower limit value of the average value $i_{AVE}$ of the intervals between the R-rich phases 6 in the easy magnetization axis direction C. The width of the permanent magnet 2 in the easy magnetization axis direction C may be, for example, from several mm to several hundred mm or from several tens mm to sever hundred mm. A longitudinal width of the permanent magnet 2 in the direction perpendicular to the easy magnetization axis direction C may also be, for example, from several mm to several hundred mm or from several ten mm to several hundred mm. A width of the permanent magnet 2 in the direction perpendicular to the easy magnetization axis direction C may also be, for example, from several mm to several hundred mm or from several ten mm to several hundred mm.

Grain boundary phases other than the R-rich phase 6 may be included in a grain boundary. For example, the grain boundary may contain grain boundary phases containing an element introduced into the permanent magnet 2 by a grain boundary diffusion step described later. The element introduced into the permanent magnet 2 by the grain boundary diffusion step may be at least one heavy rare earth element of Tb and Dy. The elements introduced into the permanent magnet 2 by the grain boundary diffusion step may be a heavy rare earth element and a light rare earth element, and the light rare earth element may be at least one of Nd and Pr. The elements introduced into the permanent magnet 2 by the grain boundary diffusion step may be a heavy rare earth element, a light rare earth element, and copper.

Each of the main phase grain 4 and the R-rich phase 6 can be identified based on a contrast of an image of the cross section 2*cs* of the permanent magnet 2 photographed by a scanning electron microscope (SEM) or a scanning transmission electron microscope (STEM). The composition of each of the main phase grain 4 and the R-rich phase 6 may be analyzed by an electron probe microanalyzer (EPMA) in which an energy dispersive X-ray spectroscopy (EDS) device is equipped.

An overall composition of the permanent magnet 2 will be described below. However, the composition of the permanent magnet 2 is not limited to the following composition. A content of each element in the permanent magnet 2 may be out of the following range.

A total content of the rare earth element R in the permanent magnet 2 may be from 25.00 mass % to 35.00 mass % or from 28.00 mass % to 33.00 mass %. When the content of R is within the above range, the residual magnetic flux density and the coercivity of the permanent magnet 2 are likely to increase. When the content of R is too small, $R_2T_{14}B$ composing the main phase grain 4 is unlikely to be formed, and an α-Fe phase having soft magnetism is likely to be formed. As a result, the coercivity is likely to decrease. On the other hand, when the content of R is too large, a volume ratio of the main phase grains 4 decreases, and the residual magnetic flux density is likely to decrease. Since the residual magnetic flux density and the coercivity are likely to increase, a total ratio of Nd and Pr to the entire rare earth element R may be from 80 atom % to 100 atom % or from 95 atom % to 100 atom %.

A total value of a content of Tb and Dy in the permanent magnet 2 may be from 0.20 mass % to 5.00 mass %. When the permanent magnet 2 includes at least one heavy rare earth element of Tb and Dy, a magnetic property (particularly, coercivity at high temperature) of the permanent magnet 2 is likely to increase. However, the permanent magnet 2 does not have to include Tb and Dy.

A content of B in the permanent magnet 2 may be from 0.70 mass % to 1.10 mass % or from 0.80 mass % to 1.10 mass %. When the content of B is 0.70 mass % or more, the residual magnetic flux density is likely to increase. When the content of B is 1.10 mass % or less, the coercivity of the permanent magnet 2 is likely to increase. When the content of B is within the above range, a squareness ratio (Hk/HcJ) of the permanent magnet 2 is likely to approach 1.0. Hk is an intensity of a demagnetization field corresponding to 90% of a residual magnetic flux density in a second quadrant of a demagnetization curve.

When the total content of the rare earth element R in the permanent magnet 2 is from 28.00 mass % to 33.00 mass %, and the content of B in the permanent magnet 2 is from 0.80 mass % to 1.10 mass %, the content of the rare earth element R in the permanent magnet 2 is more than a stoichiometric ratio of $R_2T_{14}B$. As a result, in a hot plastic deforming step described later, liquid phases are likely to be generated at grain boundaries. The liquid phases at the grain boundaries promote anisotropic growth of crystal grains ($R_2T_{14}B$), grain boundary sliding, and the rotation of crystal grains. As a result, the c-axes of the crystal grains are likely to be oriented in a stress direction, a packing density of the crystal grains in the permanent magnet 2 is likely to increase, and the coercivity and the residual magnetic flux density of the permanent magnet 2 are likely to increase.

The permanent magnet 2 may include gallium (Ga). A content of Ga may be from 0.03 mass % to 1.00 mass % or from 0.20 mass % to 0.80 mass %. When the content of Ga is within the above range, the generation of sub phases (for example, a phase including R, T, and Ga) is appropriately suppressed, and the residual magnetic flux density and the coercivity of the permanent magnet 2 are likely to increase. However, the permanent magnet 2 does not have to include Ga.

The permanent magnet 2 may include aluminum (Al). A content of Al in the permanent magnet 2 may be from 0.01 mass % to 0.2 mass % or from 0.04 mass % to 0.07 mass %. When the content of Al is within the above range, the coercivity and the corrosion resistance of the permanent magnet are likely to be improved. However, the permanent magnet 2 does not have to include Al.

The permanent magnet 2 may include copper (Cu). A content of Cu in the permanent magnet 2 may be from 0.01 mass % to 1.50 mass % or from 0.04 mass % to 0.50 mass %. When the content of Cu is within the above range, the coercivity, the corrosion resistance, and the temperature property of the permanent magnet 2 are likely to be improved. However, the permanent magnet 2 does not have to include Cu.

The permanent magnet 2 may include cobalt (Co). A content of Co in the permanent magnet 2 may be from 0.30 mass % to 6.00 mass % or from 0.30 mass % to 4.00 mass %. When the permanent magnet 2 includes Co, the Curie temperature of the permanent magnet 2 is likely to be heightened. When the permanent magnet 2 includes Co, the corrosion resistance of the permanent magnet 2 is likely to be improved. However, the permanent magnet 2 does not have to include Co.

A balance of the permanent magnet 2 excluding the above elements may be Fe alone or Fe and other elements. In order to make the permanent magnet 2 have a sufficient magnetic property, a total content of the elements other than Fe in the balance may be 5 mass % or less with respect to a total mass of the permanent magnet 2.

The permanent magnet 2 may include at least one selected from a group consisting of silicon (Si), titanium (Ti), manganese (Mn), zirconium (Zr), vanadium (V), chromium (Cr), nickel (Ni), niobium (Nb), molybdenum (Mo), hafnium (Hf), tantalum (Ta), tungsten (W), bismuth (Bi), tin (Sn), calcium (Ca), carbon (C), nitrogen (N), oxygen (O), chlorine (Cl), sulfur (S), and fluorine (F), as the other elements (for example, inevitable impurities). A total content of the other elements in the permanent magnet 2 may be from 0.001 mass % to 0.50 mass %.

The overall composition of the permanent magnet 2 may be analyzed by, for example, an X-ray fluorescence (XRF) analysis method, a radiofrequency inductively coupled plasma (ICP) optical emission spectrometry method (ICP-OES), an inert gas fusion-nondispersive infrared absorption (NDIR) method, infrared absorption method after combustion with oxygen, an inert gas fusion-thermal conductivity method, and the like.

The permanent magnet 2 may be applied to motors, generators, actuators, or the like. For example, the permanent magnet 2 is used in various fields such as hybrid vehicles, electric vehicles, hard disk drives, magnetic resonance imaging (MRI), smartphones, digital cameras, thin TVs, scanners, air conditioners, heat pumps, refrigerators, vacuum cleaners, washing and drying machines, elevators, and wind power generators.

(Method for Producing Permanent Magnet)

A method for producing a permanent magnet according to the present embodiment includes at least a ribbon production step, a first transport step, a pulverization and classification step, a second transport step, a hot pressing step, a third transport step, and a hot plastic deforming step. The method for producing a permanent magnet may further include other steps such as the grain boundary diffusion step following the hot plastic deforming step. However, the grain boundary diffusion step is not essential.

The present inventors consider that R-rich phases are formed by the oxidation of R in the vicinity of a surface of an alloy ribbon or alloy powder in a production process of a permanent magnet. In order to suppress the generation of the R-rich phases, each step described below is executed in a non-oxidizing atmosphere. However, it is difficult to control the average value $i_{AVE}$ of intervals between the R-rich phases in an easy magnetization axis direction to a value of 5 μm or more only with the execution of each step in a non-oxidizing atmosphere. In order to control the average value $i_{AVE}$ of the intervals between the R-rich phases in the easy magnetization axis direction to a value of 5 μm or more, controlling a concentration of oxygen in an atmosphere of each transport step to a predetermined value or less is required. Details of each step will be described below.

The ribbon production step is a step of producing alloy ribbons from a raw material alloy (molten metal) by a super-rapid cooling and solidification method. In the super-rapid cooling and solidification method, a molten metal in a container (crucible) is ejected to a surface of a cooled roll from a nozzle located at a tip of the container. The molten metal comes into contact with the surface of the cooled roll, and is instantly flipped from the cooled roll rotating at high speed to form a large number of elongated ribbon-shaped fragments. The molten metal is rapidly cooled by contact with the surface of the cooled roll to be solidified. As a result, a large number of elongated alloy ribbons are formed. Another container is installed in a direction in which the alloy ribbons are flipped by the cooled roll, and the alloy ribbons are collected into the container.

The molten metal is composed of metals (raw material metals) including each element composing the permanent magnet. The raw material metal may be, for example, a simple substance of a rare earth element (metal simple substance), an alloy including a rare earth element, pure iron, ferro-boron, or an alloy including these elements. The raw material metals are weighed to match a desired composition of the permanent magnet.

The molten metal may be obtained by heating the raw material metals in the container via high frequency induction heating. The temperature (ejection temperature) of the molten metal ejected from the nozzle may be, for example, approximately 1,400° C. The heating rate until the temperature of the raw material metals reach the ejection temperature may be, for example, approximately from 20 to 100° C./sec.

The surface of the cooled roll may be composed of a metal having a high thermal conductivity such as Cu. The temperature of the surface of the cooled roll may be controlled by a refrigerant flowing in the cooled roll. The temperature of the surface of the cooled roll may be controlled such that the cooling rate of the molten metal on the surface of the cooled roll is, for example, approximately from $10^5$ to $10^{6}$° C./sec. The higher the cooling rate is, the grain sizes of crystals ($R_2T_{14}B$) contained in the alloy ribbons are more likely to be fine and the coercivity of the permanent magnet is likely to be higher. The less the amount of the molten metal ejected to the surface of the cooled roll per unit time is, the molten metal adhering to the surface of the cooled roll is thinner, the cooling rate is higher, and the alloy ribbons also are thinner. The higher the peripheral speed (linear speed) of the cooled roll is, the molten metal adhering to the surface of the cooled roll is thinner, the cooling rate is higher, and the alloy ribbons also are thinner. Thicknesses of main phase grains in the easy magnetization axis direction (lengths of the short axes of the main phase grains) depend on thicknesses of the alloy ribbons (and the pulverization and classification of the alloy ribbons). The thinner the alloy ribbons are, the thicknesses (grain sizes) of the main phase grains are smaller and the coercivity of the permanent magnet tends to be higher. However, one of causes of generation of the R-rich phases is the oxidation of surfaces of the alloy ribbons. The thinner the alloy ribbons are, the more likely the thin main phase grains with oxidized surface are to be contained in the permanent magnet and the less the intervals between the R-rich phases in the easy magnetization axis direction tend to be. For compatibility between a high coercivity of the permanent magnet and a large interval between the R-rich phases, a thickness of the alloy ribbon may be, for example, from 20 μm to 60 μm or from 30 μm to 50 μm. A width of the alloy ribbon may be, for example, from 1.0 mm to 5.0 mm.

In order to suppress the oxidation of the molten metal, the atmosphere in the container of the molten metal may be replaced with an inert gas such as argon (Ar) gas. The atmospheric pressure in the container of the molten metal may be, for example, from 100 kPa to 240 kPa.

The cooled roll is installed in a chamber. One of causes of generation of the R-rich phases is the preferential oxidation of R included in the vicinity of the surfaces of the alloy ribbons. In order to suppress the generation of the R-rich phases caused by the oxidation of the molten metal and the alloy ribbons, the atmosphere in the chamber may be replaced with an inert gas such as argon (Ar) gas. For the same reason, the atmosphere in the chamber may contain a reduction gas such as hydrogen gas ($H_2$) in addition to an inert gas. A concentration of the hydrogen gas in the atmosphere in the chamber may be, for example, from 0.1 mass % to 0.5 mass %. The oxidation of the molten metal and the alloy ribbons (generation of the R-rich phases) is further suppressed by reducing character of hydrogen in the atmosphere in the chamber. Therefore, when the atmosphere in the chamber includes hydrogen, the intervals between the R-rich phases in the easy magnetization axis direction are likely to increase further, and the average value $i_{AVE}$ of the intervals between the R-rich phases is likely to be 5 μm or more. As a concentration of hydrogen in the atmosphere in the chamber increases, the intervals between the R-rich phases in the easy magnetization axis direction are likely to increase further, and the average value $i_{AVE}$ of the intervals between the R-rich phases is likely to be 5 μm or more. The atmospheric pressure in the chamber may be, for example, from 60 kPa to 200 kPa. The molten metal is not immediately cooled to room temperature on the surface of the cooled roll. The temperature of the alloy ribbon immediately after solidification is still high, and the alloy ribbon continues to be cooled because of heat conduction to a housing of a super-rapid cooling and solidification device and the atmosphere in the chamber. When the atmospheric pressure in the chamber is low (for example, when the atmospheric pressure in the chamber is 20 kPa), the heat conduction from the alloy ribbon to the atmosphere in the chamber is small, and the cooling rate of the alloy ribbon is slow. When the cooling rate is slow, excessive R with respect to the stoichiometric ratio of $R_2T_{14}B$ is discharged from the inside to the surface of the alloy ribbon. As a result, R becomes excessive in the vicinity of the surface of the alloy ribbon, R-oxides are likely to be formed in the surface of the alloy ribbon, and the interval between the R-rich phases in the easy magnetization axis direction is likely to be less than 5 μm.

The atmospheric pressure in the container of the molten metal is higher than the atmospheric pressure in the chamber. A difference between the atmospheric pressure in the container of the molten metal and the atmospheric pressure in the chamber is a pressure of the molten metal ejected from the nozzle (ejection differential pressure).

The first transport step is executed after the ribbon production step. The first transport step is a step of transporting the alloy ribbons produced by the super-rapid cooling and solidification method to a pulverization and classification device used in the pulverization and classification step. An atmosphere of the first transport step is a non-oxidizing atmosphere. That is, the alloy ribbons are kept in a non-oxidizing atmosphere from the time the alloy ribbons are formed to the time the alloy ribbons reach the pulverization and classification device. For example, an atmosphere in a transport path communicating from the super-rapid cooling and solidification device (chamber in which the cooled roll is installed) to the pulverization and classification device may be a non-oxidizing atmosphere, and the alloy ribbons may be transported in the transport path. The alloy ribbons contained in a container filled with a non-oxidizing atmosphere may be transported from the chamber to the pulverization and classification device. The atmosphere (non-oxidizing atmosphere) of the first transport step may be, for example, an inert gas such as Ar gas. A concentration of oxygen in the atmosphere of the first transport step is from 0 mass ppm to 20 mass ppm. The lower the concentration of oxygen in the atmosphere of the first transport step is, the surfaces of the alloy ribbons are more unlikely to be oxidized during the first transport step and a large number of the R-rich phases deriving from the oxidized surfaces of the alloy ribbons are more unlikely to be included in the permanent magnet. As a result, the intervals between the R-rich phases in the easy magnetization axis direction are likely to increase, and the average value $i_{AVE}$ of the intervals between the R-rich phases is likely to be 5 μm or more. On the other hand, when the concentration of oxygen in the atmosphere of the first transport step is higher than 20 mass ppm, the intervals between the R-rich phases in the easy magnetization axis direction are likely to decrease, and the average value $i_{AVE}$ of the intervals between the R-rich phases is likely to be less than 5 μm.

The pulverization and classification step is executed after the first transport step. The pulverization and classification step is a step of pulverizing the alloy ribbons using a pulverization device to produce coarse powder, and of classifying the coarse powder to collect alloy powder having predetermined particle diameters. The alloy powder is a precursor of the the permanent magnet. The shape of each alloy particle composing the alloy powder may be a plate shape or a flaky shape. A method for pulverizing the alloy ribbons may be, for example, at least one method of cutter milling and propeller milling. Means for classifying the coarse powder may be, for example, a sieve. Particle diameters and a particle diameter distribution of the alloy powder obtained by the classification may be measured, for example, by a laser diffraction scattering method. The particle diameters of the alloy powder obtained by the classification may be, for example, from 50 μm to 300 μm, preferably from 50 μm to 200 μm. In other words, an inner diameter of an opening of a sieve for classification may be from 50 μm to 300 μm, preferably from 50 μm to 200 μm.

Since a specific surface area of the alloy powder is more than a specific surface area of the alloy ribbon, the alloy powder is more likely to be oxidized than the alloy ribbon. (Since the specific surface area of the alloy ribbon is more than a specific surface area of a green compact formed from the alloy powder, the alloy ribbon is more likely to be oxidized than the green compact.) The less the particle diameters of the alloy powder are, the specific surface area of the alloy powder is larger and the surface of the alloy powder is more likely to be oxidized. A large number of the R-rich phases deriving from the oxidized surface of the alloy powder are likely to be included in the permanent magnet because of the oxidation of the alloy powder. Therefore, the less the particle diameters of the alloy powder are, the intervals between the R-rich phases in the easy magnetization axis direction are more likely to decrease and the average value $i_{AVE}$ of the intervals between the R-rich phases is to more likely be less than 5 μm. In other words, the more the particle diameters of the alloy powder are, the specific surface area of the alloy powder is smaller and the oxidation of the surface of the alloy powder is suppressed. Since the oxidation of the alloy powder is suppressed, the number of the R-rich phases included in the permanent magnet is reduced. Therefore, the more the particle diameters of the alloy powder are, the intervals between the R-rich phases in the easy magnetization axis direction are more likely to increase and the average value $i_{AVE}$ of the intervals between the R-rich phases is more likely to be 5 μm or more.

An atmosphere of the pulverization and classification step is a non-oxidizing atmosphere. When the pulverization and classification step is executed under a non-oxidizing atmosphere, the oxidation of the alloy ribbons, the coarse powder, and the alloy powder is suppressed during the pulverization and classification step. As a result, the intervals between the R-rich phases in the easy magnetization axis direction are likely to increase, and the average value $i_{AVE}$ of the intervals between the R-rich phases is likely to be 5 μm or more. The atmosphere (non-oxidizing atmosphere) of the pulverization and classification step may be, for example, an inert gas such as Ar gas. A concentration of oxygen in the atmosphere of the pulverization and classification step is from 0 mass ppm to 20 mass ppm. The lower the concentration of oxygen in the atmosphere of the pulverization and classification step is, the intervals between the R-rich phases in the easy magnetization axis direction are more likely to increase and the average value $i_{AVE}$ of the intervals between the R-rich phases is more likely to be 5 μm or more. On the other hand, when the concentration of oxygen in the atmosphere of the pulverization and classification step is higher than 20 mass ppm, the intervals between the R-rich phases in the easy magnetization axis direction are likely to decrease, and the average value $i_{AVE}$ of the intervals between the R-rich phases is likely to be less than 5 μm.

The second transport step is executed after the pulverization and classification step. The second transport step is a step of transporting the alloy powder obtained by the pulverization and classification step to a pressing device used in the hot pressing step. An atmosphere of the second transport step is a non-oxidizing atmosphere. That is, the alloy powder is kept in a non-oxidizing atmosphere from the time the alloy powder is formed to the time the alloy powder reaches the pressing device. For example, an atmosphere in a transport path communicating from the pulverization and classification device to the pressing device may be a non-oxidizing atmosphere, and the alloy powder may be transported in the transport path. The alloy powder contained in a container filled with a non-oxidizing atmosphere may be transported from the pulverization and classification device to the pressing device. The atmosphere (non-oxidizing atmosphere) of the second transport step may be, for example, an inert gas such as Ar gas. A concentration of oxygen in the atmosphere of the second transport step is from 0 mass ppm to 20 mass ppm. The lower the concentration of oxygen in the atmosphere of the second transport step is, the surface of the alloy powder is more unlikely to be oxidized during the second transport step and a large number of the R-rich phases deriving from the oxidized surface of the alloy powder are more unlikely to be included in the permanent magnet. As a result, the intervals between the R-rich phases in the easy magnetization axis direction are likely to increase, and the average value $i_{AVE}$ of the intervals between the R-rich phases is likely to be 5 μm or more. On the other hand, when the concentration of oxygen in the atmosphere of the second transport step is higher than 20 mass ppm, the intervals between the R-rich phases in the easy magnetization axis direction are likely to decrease, and the average value $i_{AVE}$ of the intervals between the R-rich phases is likely to be less than 5 μm.

The hot pressing step is executed after the second transport step. The hot pressing step is a step of pressing the alloy powder under heating to form a green compact (hot-pressed magnet). For example, the alloy powder may be compressed in the press mold while the alloy powder in a press mold is heated. Voids between alloy powder particles are reduced by pressing the alloy powder to obtain a dense green compact. In addition, liquid phases are formed from the surface of the alloy powder by heating the alloy powder with pressing, the voids (grain boundaries) between the alloy powder particles are filled with the liquid phases, and the alloy powder is lubricated by the liquid phases, so that a dense green compact is obtained. A cold pressing step may be executed before the hot pressing step. In the cold pressing step, the alloy powder may be pressed at normal temperature (room temperature) to form a green compact. In the hot pressing step, the green compact obtained by the cold pressing step may be pressed under heating to densify the green compact. The temperature of the alloy powder in the hot pressing step (hot pressing temperature) may be, for example, from 700° C. to 800° C. When the hot pressing temperature is too low, sufficient liquid phases are not formed from the surface of the alloy powder, and the green compact is unlikely to be densified. When the hot pressing temperature is too high, the grain growth of crystals ($R_2T_{14}B$) composing the alloy powder makes progress excessively, and the coercivity of the permanent magnet is likely to decrease. A pressure (hot pressing pressure) applied to the alloy powder in the hot pressing step may be from 50 MPa to 200 MPa. A time for which the hot pressing temperature and the hot pressing pressure are held within the above respective ranges (hot pressing time) may be, for example, from several ten second to several hundred second.

Grain boundary phases formed during the hot pressing step are substantially uniformly distributed in the vicinities of surfaces of crystal grains. In addition, the grain boundary phases formed during the hot pressing step are finer than the R-rich phases caused by oxidation, and are unlikely to be detected during measurement of the intervals between the R-rich phases. Therefore, the grain boundary phases formed during the hot pressing step are unlikely to affect the intervals between the R-rich phases caused by oxidation.

In order to suppress the oxidation of the alloy powder and the green compact in the hot pressing step, the hot pressing step may be executed in a non-oxidizing atmosphere. The atmosphere (non-oxidizing atmosphere) of the hot pressing step may be, for example, an inert gas such as Ar gas. A concentration of oxygen in the atmosphere of the hot pressing step may be, for example, from 0 mass ppm to 20 mass ppm.

The third transport step is executed after the hot pressing step. The third transport step is a step of transporting the green compact obtained by the hot pressing step to a pressing device used in the hot plastic deforming step. In order to suppress the oxidation of the green compact, an atmosphere of the third transport step may be a non-oxidizing atmosphere. That is, the green compact may be kept in a non-oxidizing atmosphere from the time the green compact is formed to the time the green compact reaches the pressing device for hot plastic deforming. For example, an atmosphere in a transport path communicating from the pressing device for hot pressing to the pressing device for hot plastic deforming may be a non-oxidizing atmosphere, and the green compact may be transported in the transport path. The green compact contained in a container filled with a non-oxidizing atmosphere may be transported from the pressing device for hot pressing to the pressing device for hot plastic deforming. The atmosphere of the third transport step may be, for example, an inert gas such as Ar gas. Since the specific surface area of the green compact formed from the alloy powder is much less than the specific surface area of each of the alloy powder and the alloy ribbon, the green compact (particularly, the inside of the green compact) is more unlikely to be oxidized than the alloy powder and the alloy ribbon. Therefore, even when a concentration of oxygen in the atmosphere of the third transport step is higher than the concentration of oxygen in the atmosphere of each of the first transport step and the second transport step, the average value $i_{AVE}$ of the intervals between the R-rich phases can be controlled to 5 μm or more. For example, when the atmosphere of the third transport step is air, the average value $i_{AVE}$ of the intervals between the R-rich phases can be controlled to 5 μm or more by reducing the concentration of oxygen in the atmosphere of each of the first transport step and the second transport step. The concentration of oxygen in the atmosphere of the third transport step may be from 0 mass ppm to 200,000 mass ppm, preferably from 0 mass ppm to 2,000 mass ppm, and more preferably from 0 mass ppm to 20 mass ppm.

The hot plastic deforming step is executed after the third transport step. The hot plastic deforming step is a step of obtaining a magnet base material containing a plurality of the main phase grains (crystal grains of $R_2T_{14}B$) of which the c-axes (easy magnetization axes) are oriented (aligned) in a predetermined direction by hot extrusion (hot extrusion molding) of the green compact obtained by the hot pressing step. For example, in the hot plastic deforming step, the green compact is extruded from a press mold while the green compact is heated. In the press mold, the grain boundary phases in the heated green compact are liquefied to generate liquid phases, and a stress is applied to the green compact in a predetermined direction. The anisotropic growth of the crystal grains in a direction perpendicular to the c-axis of each of the crystal grains makes progress with the generation of the liquid phases. In addition, the liquid phases lubricate each crystal grain, and a force is applied to each crystal grain according to the stress. As a result, the crystal grains rotate because of grain boundary sliding, and the c-axis of each crystal grain (main phase grain) is oriented substantially parallel to a stress direction. In other words, the plurality of main phase grains that are flat and extend in the direction substantially perpendicular to the c-axis are stacked along the stress direction. The temperature of the green compact in the hot plastic deforming step (hot plastic deforming temperature) may be, for example, from 700° C. to 800° C. When the hot plastic deforming temperature is too low, liquid phases are unlikely to be generated in grain boundaries inside the green compact, the anisotropic growth of the crystal grains is unlikely to make progress, and the rotation of the crystal grains caused by grain boundary sliding is unlikely to occur. As a result, the c-axis of each crystal grain is unlikely to be oriented substantially parallel to the stress direction, and the coercivity and the residual magnetic flux density of the magnet base material are likely to decrease. When the hot plastic deforming temperature is too high, the grain growth of the crystal grains makes progress excessively, and the coercivity of the magnet base material is likely to decrease. A pressure (hot plastic deforming pressure) applied to the green compact in the hot plastic deforming step may be from 50 MPa to 200 MPa. A time for which the hot plastic deforming temperature and the hot plastic deforming pressure are held within the above respective ranges (hot plastic deforming time) may be, for example, several ten second.

Grain boundary phases formed during the hot plastic deforming step are substantially uniformly distributed in the vicinities of the surfaces of the crystal grains. In addition, the grain boundary phases formed during the hot plastic deforming step are finer than the R-rich phases caused by oxidation, and are unlikely to be detected during measurement of the intervals between the R-rich phases. Therefore, the grain boundary phases formed during the hot plastic deforming step are unlikely to affect the intervals between the R-rich phases caused by oxidation.

In order to suppress the oxidation of the green compact and the magnet base material in the hot plastic deforming step, the hot plastic deforming step may be executed in a non-oxidizing atmosphere. An atmosphere (non-oxidizing atmosphere) of the hot plastic deforming step may be, for example, an inert gas such as Ar gas. A concentration of oxygen in the atmosphere of the hot plastic deforming step may be, for example, from 0 mass ppm to 20 mass ppm.

The magnet base material obtained by the above steps may be a finished product of the permanent magnet. The magnet base material that has undergone the following grain boundary diffusion step may be a finished product of the permanent magnet.

The following grain boundary diffusion step may be executed after the hot plastic deforming step. The grain boundary diffusion step is a step of causing a diffusing material (diffusant) containing a heavy rare earth element to adhere to a surface of the magnet base material, and of heating the diffusing material and the magnet base material. The magnet base material to which the diffusing material has adhered is heated, so that the heavy rare earth element in the diffusing material diffuses from the surface of the magnet base material to the inside of the magnet base material. The heavy rare earth element diffuses to the vicinities of the surfaces of the main phase grains via the grain boundaries inside the magnet base material. A part of light rare earth elements (Nd and the like) are replaced with the heavy rare earth element in the vicinities of the surfaces of the main phase grains. Since the heavy rare earth element is localized in the vicinities of the surfaces of the main phase grains and at the grain boundaries, an anisotropic magnetic field increases locally in the vicinities of the grain boundaries, and a nucleus of magnetization reversal is unlikely to be generated in the vicinities of the grain boundaries. As a result, the permanent magnet having a high coercivity is obtained.

In the grain boundary diffusion step, each element included in the diffusing material diffuses substantially uniformly to each grain boundary in the magnet base material and to the surface of each crystal grain. In addition, grain boundary phases formed from each element deriving from the diffusing material are finer than the R-rich phases caused by oxidation, and are unlikely to be detected during measurement of the intervals between the R-rich phases. Therefore, each element deriving from the diffusing material is unlikely to affect the intervals between the R-rich phases caused by oxidation.

In order to suppress the oxidation of the magnet base material in the grain boundary diffusion step, the grain boundary diffusion step may be executed in a non-oxidizing atmosphere. An atmosphere (non-oxidizing atmosphere) of the grain boundary diffusion step may be, for example, an inert gas such as Ar gas. A concentration of oxygen in the atmosphere of the grain boundary diffusion step may be, for example, from 0 mass ppm to 20 mass ppm. An atmospheric pressure of the atmosphere of the grain boundary diffusion step may be, for example, from 50 kPa to 120 kPa. A temperature (diffusion temperature) of the diffusing material and the magnet base material in the grain boundary diffusion step may be, for example, from 550° C. to 900° C. A time (diffusion time) for which the diffusion temperature is held within the above range may be, for example, from 1 minute to 1,440 minutes.

The diffusing material may include at least one heavy rare earth element of Tb and Dy. The diffusing material may further include at least one light rare earth element of Nd and Pr in addition to the heavy rare earth element. The diffusing material may further include Cu in addition to the heavy rare earth element and the light rare earth element. The diffusing material may be, for example, a metal consisting of one of the above elements, a hydride of one of the above elements, an alloy containing a plurality of the above elements, or a hydride of the alloy. The diffusing material may be powder. In the grain boundary diffusion step, a slurry containing the diffusing material and an organic solvent may be applied to the surface of the magnet base material. In the grain boundary diffusion step, the surface of the magnet base material may be covered with a sheet containing the diffusing material and a binder. In the grain boundary diffusion step, the surface of the magnet base material may be covered with an alloy foil (ribbon) composed of the diffusing material.

In order to promote the diffusion of the diffusing material, the surface of the magnet base material may be polished before the grain boundary diffusion step. In order to remove the diffusing material remaining on the surface of the magnet base material after the grain boundary diffusion step, the surface of the magnet base material may be polished after the grain boundary diffusion step.

The magnet base material may be cut and polished to adjust the dimensions and the shape of the magnet base material. A passive layer may be formed on the surface of the magnet base material by the oxidation of the surface of the magnet base material or by a chemical treatment to the surface of the magnet base material. The surface of the magnet base material may be covered with a protective film such as a resin film. The corrosion resistance of the permanent magnet is improved by the passive layer or the protective film.

The present invention is not necessarily limited to the above-described embodiment. The present invention can be changed in various forms without departing from the concept of the present invention, and modification examples are also included in the present invention.

EXAMPLES

The present invention will be described in detail with reference to the following examples and comparative examples. The present invention is not limited by the following examples.

<Production of Permanent Magnet>

Example 1

In the ribbon production step, an alloy ribbons were produced from a raw material alloy (molten metal) by the super-rapid cooling and solidification method. The raw material metals composing the molten metal used in the ribbon production step included Nd, Fe, Co, Ga, Al, and B.

A content of Nd in the raw material metals was 30.17 mass %.

A content of Co in the raw material metals was 3.96 mass %.

A content of Ga in the raw material metals was 0.59 mass %.

A content of Al in the raw material metals was 0.04 mass %.

A content of B in the raw material metals was 0.97 mass %.

A balance of the raw material metals excluding Nd, Co, Ga, Al, and B was Fe.

The temperature of the molten metal ejected from the nozzle (ejection temperature) was 1,400° C. The heating rate until the temperature of the raw material metal reached the ejection temperature was 100° C./sec. The cooling rate of the molten metal on the surface of the cooled roll was controlled to approximately $10^{5}$° C./sec. A hole diameter of the nozzle was 0.6 mm. The peripheral speed of the cooled roll was 40 msec.

The gas in the nozzle (atmosphere in the container of the molten metal) was Ar. The pressure of the nozzle (atmospheric pressure in the container of the molten metal) was 100 kPa.

The gas (atmosphere) in the chamber in which the cooled roll was installed was Ar. A concentration of hydrogen gas in the atmosphere in the chamber was 0.00 mass %. The pressure of the chamber (atmospheric pressure in the chamber) was 60 kPa. The ejection differential pressure was 40 kPa.

In the first transport step after the ribbon production step, the alloy ribbons were transported from the super-rapid cooling and solidification device to the pulverization and classification device. The gas (atmosphere) of the first transport step was Ar. A concentration of oxygen in the atmosphere of the first transport step was 20 mass ppm.

In the pulverization and classification step after the first transport step, alloy powder having predetermined particle diameters was produced by the pulverization of the alloy ribbons and classification. A lower limit value of inner diameters of openings of a sieve used for classification was 50 μm. An upper limit value of the inner diameters of the openings of the sieve used for classification was 200 μm. Therefore, the particle diameters of the alloy powder were in a range of 50 μm to 200 μm.

The gas (atmosphere) of the pulverization and classification step was Ar. A concentration of oxygen in the atmosphere of the pulverization and classification step was 20 mass ppm.

In the second transport step after the pulverization and classification step, the alloy powder was transported from the pulverization and classification device to the pressing device. The gas (atmosphere) of the second transport step was Ar. A concentration of oxygen in the atmosphere of the second transport step was 20 mass ppm.

In the hot pressing step after the second transport step, the alloy powder was compressed while heating it in the press mold to produce a green compact. The green compact was a thin plate. A length of the green compact was 80 mm, a width of the green compact was 22 mm, and a thickness of the green compact was 11 mm. The hot pressing temperature was 750° C. The hot pressing pressure was 100 MPa. The hot pressing time was 300 sec. The gas (atmosphere) of the hot pressing step was Ar. A concentration of oxygen in the atmosphere of the hot pressing step was 20 mass ppm.

In the third transport step after the hot pressing step, the green compact was transported from the pressing device for hot pressing to the pressing device for hot plastic deforming. The gas (atmosphere) of the third transport step was Ar. A concentration of oxygen in the atmosphere of the third transport step was 20 mass ppm.

The hot plastic deforming step was executed after the third transport step. The press mold (die) used for the hot plastic deforming step (hot extrusion molding of the green compact) has a cylindrical shape. That is, a cavity of the press mold penetrates through the press mold from an end surface (starting end surface) of the press mold in which an inlet for the green compact is open toward an end surface (termination end surface) of the press mold in which an extrusion outlet for the green compact is open. The starting end surface and the termination end surface are flat surfaces parallel to each other. A direction from the starting end surface to the termination end surface is an extrusion direction of the green compact, and the extrusion direction is perpendicular to the staring end surface and to the termination end surface. An opening area of the extrusion outlet for the green compact is less than an opening area of the inlet for the green compact.

The cavity is sectioned into an inlet side region, an intermediate region, and an extrusion outlet side region along the extrusion direction. The inlet side region is open in the starting end surface. The extrusion outlet side region is open in the termination end surface. The intermediate region is located between the inlet side region and the extrusion outlet side region in the extrusion direction.

The shape of the cavity in a cross section of the press mold perpendicular to the extrusion direction (cross section of the press mold parallel to the starting end surface and the termination end surface) is a quadrilateral of which all four corners are at right angle. A pair of sides facing each other in the quadrilateral are referred to as a first side, and the other pair of sides facing each other in the quadrilateral are referred to as a second side.

A length of each of the first side and the second side in the inlet side region is constant. That is, an opening area of the inlet side region in a cross section perpendicular to the extrusion direction is constant. The length of the first side gradually decreases in the intermediate region along the extrusion direction, and finally coincides with the length of the first side in the extrusion outlet side region. Therefore, the first side in the extrusion outlet side region is shorter than the first side in the inlet side region. In addition, the length of the second side gradually increases in the intermediate region along the extrusion direction, and finally coincides with the length of the second side in the extrusion outlet side region. Therefore, the second side in the extrusion outlet side region is longer than the second side in the inlet side region. Further, an opening area of the intermediate region in a cross section perpendicular to the extrusion direction gradually decreases along the extrusion direction, and finally coincides with an opening area of the extrusion outlet side region in a cross section perpendicular to the extrusion direction. Therefore, the opening area of the extrusion outlet side region in a cross section perpendicular to the extrusion direction is less than the opening area of the inlet side region in a cross section perpendicular to the extrusion direction. The length of each of the first side and the second side in the extrusion outlet side region is constant. That is, the opening area of the extrusion outlet side region in a cross section perpendicular to the extrusion direction is constant.

The length of the first side in the inlet side region (starting end surface) was 22 mm, and the length of the second side in the inlet side region (starting end surface) was 11 mm. The length of the first side in the extrusion outlet side region (termination end surface) was 7 mm, and the length of the second side in the extrusion outlet side region (termination end surface) was 30 mm. A length of the inlet side region in the extrusion direction was 80 mm. A length of the intermediate region in the extrusion direction was 20 mm. A length of the extrusion outlet side region in the extrusion direction was 20 mm.

As described above, the opening area of the extrusion outlet side region in a cross section perpendicular to the extrusion direction is less than the opening area of the inlet side region in a cross section perpendicular to the extrusion direction, and the first side in the extrusion outlet side region (termination end surface) is shorter than the second side in the extrusion outlet side region (termination end surface). Therefore, in the extrusion outlet side region, a stress substantially parallel to the first side is applied to the green compact to cause grain boundary sliding and the rotation of main phase grains. As a result, the c-axes of the main phase grains are oriented along a stress direction (direction of the first side). That is, an easy magnetization axis direction of a magnet base material obtained by hot extrusion molding is the direction of the first side in the extrusion outlet side region (termination end surface).

In the hot plastic deforming step, a magnet base material was produced by hot extrusion molding of the green compact using the above press mold. The temperature of the inlet of the press mold was 750° C. The temperature of the extrusion outlet of the press mold also was 750° C. The hot plastic deforming pressure was 100 MPa. The extrusion speed of hot extrusion molding was 1 mm/sec.

The gas (atmosphere) of the hot plastic deforming step was Ar. A concentration of oxygen in the atmosphere of the hot plastic deforming step was 20 mass ppm.

In the grain boundary diffusion step after the hot plastic deforming step, the magnet base material to which a diffusing material has adhered was heated. The diffusing material was powder of a hydride of a eutectic alloy consisting of Nd, Tb, and Cu. In the grain boundary diffusion step, a slurry that was a mixture of the diffusing material and an organic solvent was applied to an entire surface of the magnet base material. A content of Nd in the diffusing material was 66 mass %. A content of Tb in the diffusing material was 24 mass %. A content of Cu in the diffusing material was 10 mass %. The mass of the diffusing material adhering to the magnet base material was adjusted such that a content of Tb in a permanent magnet (magnet base material after the grain boundary diffusion step) coincided with 2 mass %.

The gas (atmosphere) of the grain boundary diffusion step was Ar. The pressure of the grain boundary diffusion step (atmospheric pressure in the atmosphere of the grain boundary diffusion step) was 100 kPa. The diffusion temperature was 650° C. The diffusion time was 300 minutes.

The permanent magnet of Example 1 was produced by the above method.

Example 2 and Comparative Examples 1 to 6

The gas (atmosphere) of the first transport step of each of Example 2 and Comparative Examples 1 to 6 is shown in Table 1 below. A concentration of oxygen in the atmosphere of the first transport step of each of Example 2 and Comparative Examples 1 to 6 is shown in Table 1 below.

The gas (atmosphere) of the second transport step of each of Example 2 and Comparative Examples 1 to 6 is shown in Table 1 below. A concentration of oxygen in the atmosphere of the second transport step of each of Example 2 and Comparative Examples 1 to 6 is shown in Table 1 below.

The gas (atmosphere) of the third transport step of each of Example 2 and Comparative Examples 1 to 6 is shown in Table 1 below. A concentration of oxygen in the atmosphere of the third transport step of each of Example 2 and Comparative Examples 1 to 6 is shown in Table 1 below.

A permanent magnet of each of Example 2 and Comparative Examples 1 to 6 was produced by the same method as in Example 1 except for the above items.

Comparative Example 7

A concentration of oxygen in an atmosphere of the first transport step of Comparative Example 7 is shown in Table 2 below. A permanent magnet of Comparative Example 7 was produced by the same method as in Example 1 except for the concentration of oxygen in the atmosphere of the first transport step.

Comparative Example 8

A concentration of oxygen in an atmosphere of the second transport step of Comparative Example 8 is shown in Table 3 below. A permanent magnet of Comparative Example 8 was produced by the same method as in Example 1 except for the concentration of oxygen in the atmosphere of the second transport step.

Example 3

A concentration of oxygen in an atmosphere of the third transport step of Example 3 is shown in Table 4 below. A permanent magnet of Example 3 was produced by the same method as in Example 1 except for the concentration of oxygen in the atmosphere of the third transport step.

Examples 4 to 6

A concentration of hydrogen gas in an atmosphere in the chamber in each of Examples 4 to 6 is shown in Table 5 below. A permanent magnet of each of Examples 4 to 6 was produced by the same method as in Example 1 except for the concentration of hydrogen gas in the atmosphere in the chamber.

Examples 7 and 8 and Comparative Example 10

The pressure of the nozzle (atmospheric pressure in the container of a molten metal) in each of Examples 7 and 8 and Comparative Example 10 is shown in Table 6 below. The pressure of the chamber (atmospheric pressure in the chamber) in each of Examples 7 and 8 and Comparative Example 10 is shown in Table 6 below. A permanent magnet of each of Examples 7 and 8 and Comparative Example 10 was produced by the same method as in Example 4 except for the above items.

Comparative Examples 11 and 12

The gas (atmosphere) of the first transport step of each of Comparative Examples 11 and 12 is shown in Table 7 below. A concentration of oxygen in the atmosphere of the first transport step of each of Comparative Examples 11 and 12 is shown in Table 7 below. A permanent magnet of each of Comparative Examples 11 and 12 was produced by the same method as in Example 4 except for the above items.

Comparative Examples 13 and 14

The gas (atmosphere) of the second transport step of each of Comparative Examples 13 and 14 is shown in Table 8 below. A concentration of oxygen in the atmosphere of the second transport step of each of Comparative Examples 13 and 14 is shown in Table 8 below. A permanent magnet of each of Comparative Examples 13 and 14 was produced by the same method as in Example 4 except for the above items.

Examples 9 and 10

The gas (atmosphere) of the third transport step of each of Examples 9 and 10 is shown in Table 9 below. A concentration of oxygen in the atmosphere of the third transport step of each of Examples 9 and 10 is shown in Table 9 below. A permanent magnet of each of Examples 9 and 10 was produced by the same method as in Example 4 except for the above items.

Example 11

A composition of a raw material alloy (molten metal) of Example 11 is shown in Table 10 below. A permanent magnet of Example 11 was produced by the same method as in Example 4 except for the composition of the raw material alloy (molten metal).

Example 12

A composition of a diffusing material of Example 12 is shown in Table 11 below. A permanent magnet of Example 12 was produced by the same method as in Example 4 except for the composition of the diffusing material.

<Analysis of Permanent Magnet>

(Composition and Microstructure of Permanent Magnet)

A cross section of the permanent magnet of each of all the examples and the comparative examples was observed by a scanning electron microscope (SEM). The observed cross section of each permanent magnet was parallel to an easy magnetization axis direction of each permanent magnet. In addition, a composition of the cross section of each permanent magnet was analyzed by an electron probe microanalyzer (EPMA) and an energy dispersive X-ray spectroscopy (EDS) device.

In the cases of all the examples and the comparative examples, the permanent magnet contained a large number of main phase grains (crystal grains of $Nd_2Fe_{14}B$) and a plurality of R-rich phases (Nd-rich phases). In the cases of all the examples and the comparative examples, each main phase grain observed in the cross section was flat, and a plurality of the main phase grains that were flat were stacked along the easy magnetization axis direction. In the cases of all the examples and the comparative examples, each R-rich phase was located between a plurality of the main phase grains. At least a part of the R-rich phases was located between the plurality of main phase grains stacked along the easy magnetization axis direction. In the cases of all the examples and the comparative examples, at least a part of the R-rich phases included Nd-oxides.

Backscattered electron images of a part of a cross section of the permanent magnet of Example 4 are illustrated in FIG. 3A, FIG. 3B, FIG. 3C, FIG. 3D, FIG. 3E, FIG. 5A and FIG. 5B. Five backscattered electron images in FIG. 3A, FIG. 3B, FIG. 3C, FIG. 3D and FIG. 3E are the same. The backscattered electron image was photographed by SEM. The cross section where the backscattered electron image was photographed was parallel to the easy magnetization axis direction.

Figure 5A:
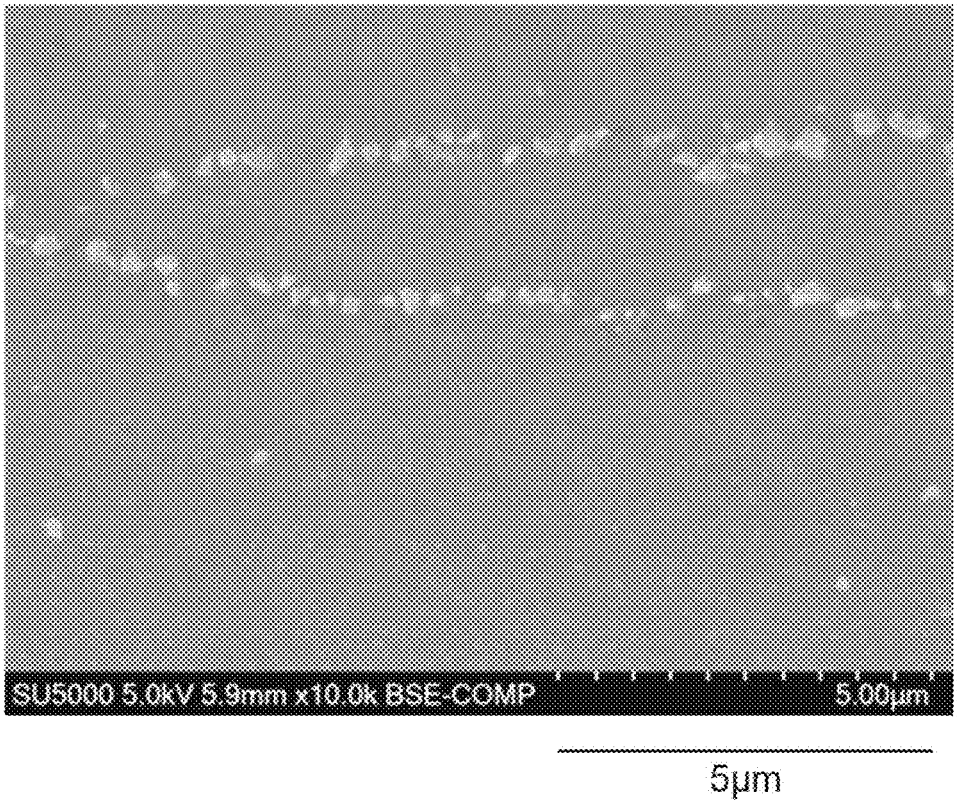
FIG. 5A and FIG. 5B illustrate backscattered electron images of R-rich phases exposed on a cross section of the R-T-B based permanent magnet of Example 4.
Figure 5B:
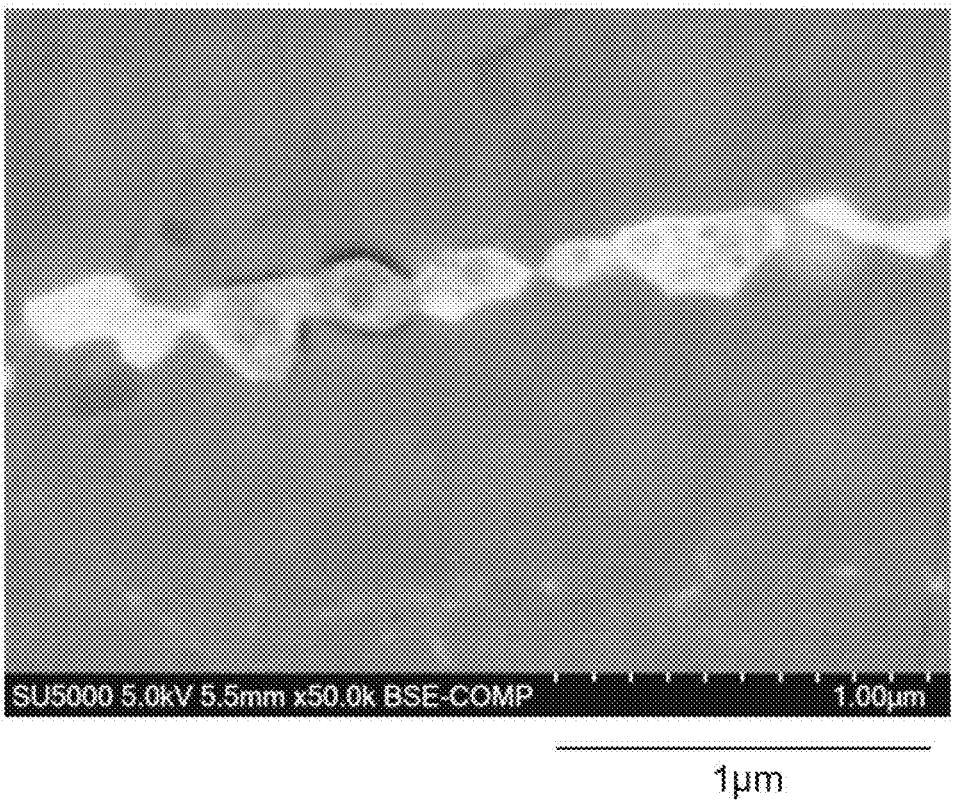

In each of measurement regions A(a), A(b), A(c), A(d), and A(e) in FIG. 3A, FIG. 3B, FIG. 3C, FIG. 3D and FIG. 3E, a luminance distribution along the easy magnetization axis direction C was measured. A width of each measurement region in the easy magnetization axis direction C was 80 μm. A width of each measurement region in the direction perpendicular to the easy magnetization axis direction C was 10 μm. In each measurement region, an average value of intervals between the R-rich phases in the easy magnetization axis direction C was measured based on the luminance distribution. The average values of the intervals between the R-rich phases in the five measurement regions were further averaged to obtain the average value $i_{AVE}$ of the intervals between the R-rich phases in the easy magnetization axis direction C. Details of the methods for measuring the luminance distribution and the interval between the R-rich phases were as described in the above embodiment. Portions having a relatively high luminance (bright portions) in FIG. 5A and FIG. 5B are examples of R-rich phases.

Backscattered electron images of a part of a cross section of the permanent magnet of Comparative Example 1 are illustrated in FIG. 4A, FIG. 4B, FIG. 4C, FIG. 4D and FIG. 4E. Five backscattered electron images in FIG. 4A, FIG. 4B, FIG. 4C, FIG. 4D and FIG. 4E are the same. The backscattered electron image was photographed by SEM. The cross sections where the backscattered electron image was photographed was parallel to the easy magnetization axis direction. In each of measurement regions A'(a), A'(b), A'(c), A'(d), and A'(e) in FIG. 4A, FIG. 4B, FIG. 4C, FIG. 4D and FIG. 4E, a luminance distribution along the easy magnetization axis direction C was measured. Then, the average value $i_{AVE}$ of intervals between the R-rich phases in Comparative Example 1 was obtained by the same method as in Example 4.

Then, the average value $i_{AVE}$ of the intervals between the R-rich phases in each of all the examples and the comparative examples was obtained by the same method as in Example 4.

(Dimensions of Main Phase Grain)

A backscattered electron image of a cross section of the permanent magnet of Example 1 was photographed by SEM. The cross section where the backscattered electron image was photographed was parallel to the easy magnetization axis direction. The dimensions of the backscattered electron image were 88 μm in length×126 μm in width. A plurality of representative locations in the backscattered electron image were selected, and a backscattered electron image of each location was photographed at a high magnification. A length of each of the long axes and the short axes of the main phase grains existing in the backscattered electron image of the high magnification was measured. The shape of each main phase grain was approximated by a rectangle having a minimum area among rectangles circumscribing the main phase grain. A length of a long side of the rectangle was regarded as the length of the long axis of the main phase grain, and a length of a short side of the rectangle was regarded as the length of the short axis of the main phase grain. An average value of the lengths of the long axes of all the main phase grains existing in the backscattered electron images of the high magnification was calculated. An average value of the lengths of the short axes of all the main phase grains existing in the backscattered electron images of the high magnification was calculated. The average value of the lengths of the long axes of the main phase grains in Example 1 was 243 nm. The average value of the lengths of the short axes of the main phase grains in Example 1 was 67.3 nm.

A length of each of the long axes and the short axes of the main phase grains in Comparative Example 1 was measured by the same method as in Example 1. An average value of the lengths of the long axes of the main phase grains in Comparative Example 1 was 261 nm. An average value of the lengths of the short axes of the main phase grains in Comparative Example 1 was 69.2 nm.

A length of each of the long axis and the short axis of the main phase grain in each of all the examples and the comparative examples was measured by the same method as in Example 1. A minimum value of average values of the lengths of the long axes of the main phase grains in examples was approximately 100 nm. A maximum value of the average values of the lengths of the long axes of the main phase grains in examples was approximately 1,000 nm. A maximum value of average values of the lengths of the short axes of the main phase grains in examples was approximately 200 nm. A minimum value of the average values of the lengths of the short axes of the main phase grains in examples was approximately 20 nm.

(Magnetic Property of Permanent Magnet)

The residual magnetic flux density (Br), the coercivity (HcJ), and the squareness ratio (Hk/HcJ) of the permanent magnet in each of all the examples and the comparative examples were measured. The residual magnetic flux density, the coercivity, and the squareness ratio were measured by a BH tracer. The coercivity was measured at 23° C. and 150° C. The Br was measured at room temperature. The squareness ratio was measured at 23° C. A temperature coefficient β of the coercivity in each of all the examples and the comparative examples was calculated. The temperature coefficient β is defined by the Formula 1 below. $HcJ_{150}$ in Equation 1 below is a coercivity at 150° C. $HcJ_{23}$ in Equation 1 below is a coercivity at 23° C.

$$\beta=100\times(HcJ_{150}-HcJ_{23})/HcJ_{23}(150-23) \quad (1)$$

Analysis results of the permanent magnets are shown in the follow tables.

TABLE 1

| | First transport step | | Second transport step | | Third transport step | | Permanent magnet Interval between |
|---|---|---|---|---|---|---|---|
| | Gas — | Oxygen concentration Mass ppm | Gas — | Oxygen concentration Mass ppm | Gas — | Oxygen concentration Mass ppm | R-rich phases $i_{AVE}$ μm |
| Comparative Example 1 | Air | 200000 | Air | 200000 | Air | 200000 | 3.009 |
| Comparative Example 2 | Ar | 20 | Air | 200000 | Air | 200000 | 2.750 |
| Comparative Example 3 | Air | 200000 | Ar | 20 | Air | 200000 | 2.877 |
| Example 2 | Ar | 20 | Ar | 20 | Air | 200000 | 5.586 |
| Comparative Example 4 | Air | 200000 | Air | 200000 | Ar | 20 | 2.917 |
| Comparative Example 5 | Ar | 20 | Air | 200000 | Ar | 20 | 2.870 |
| Comparative Example 6 | Air | 200000 | Ar | 20 | Ar | 20 | 3.010 |
| Example 1 | Ar | 20 | Ar | 20 | Ar | 20 | 5.576 |

| | Permanent magnet | | | | |
|---|---|---|---|---|---|
| | Coercivity [23° C.] HcJ kA/m | Coercivity [150° C.] HcJ kA/m | Temperature coefficient of coercivity β %/° C. | Residual magnetic flux density Br mT | Squareness ratio [23° C.] Hk/HcJ % |
| Comparative Example 1 | 797 | 316 | −0.48 | 906 | 75.3 |
| Comparative Example 2 | 781 | 298 | −0.53 | 907 | 71.8 |
| Comparative Example 3 | 806 | 308 | −0.55 | 946 | 76.0 |
| Example 2 | 1738 | 864 | −0.36 | 1144 | 92.2 |
| Comparative Example 4 | 758 | 315 | −0.46 | 893 | 75.9 |
| Comparative Example 5 | 812 | 305 | −0.53 | 918 | 74.0 |
| Comparative Example 6 | 775 | 307 | −0.52 | 917 | 71.6 |
| Example 1 | 1677 | 892 | −0.36 | 1204 | 88.5 |

TABLE 2

| | First transport step | | Permanent magnet | | | | | |
|---|---|---|---|---|---|---|---|---|
| | Gas — | Oxygen concentration Mass ppm | Interval between R-rich phases $i_{AVE}$ μm | Coercivity [23° C.] HcJ kA/m | Coercivity [150° C.] HcJ kA/m | Temperature coefficient of coercivity β %/° C. | Residual magnetic flux density Br mT | Squareness ratio [23° C.] Hk/HcJ % |
| Example 1 | Ar | 20 | 5.576 | 1677 | 892 | −0.36 | 1204 | 88.5 |
| Comparative Example 7 | Ar | 2000 | 4.018 | 1417 | 662 | −0.40 | 1126 | 74.1 |
| Comparative Example 6 | Air | 200000 | 3.010 | 775 | 307 | −0.52 | 917 | 71.6 |

TABLE 3

| | Second transport step | | Permanent magnet | | | | | |
|---|---|---|---|---|---|---|---|---|
| | | | Interval between | Coercivity | Coercivity | Temperature coefficient of | Residual magnetic | Squareness ratio |
| | Gas | Oxygen concentration | R-rich phases | [23° C.] | [150° C.] | coercivity | flux density | [23° C.] |
| | — | Mass ppm | $i_{AVE}$ μm | HcJ kA/m | HcJ kA/m | β %/° C. | Br mT | Hk/HcJ % |
| Example 1 | Ar | 20 | 5.576 | 1677 | 892 | −0.36 | 1204 | 88.5 |
| Comparative Example 8 | Ar | 2000 | 4.126 | 1466 | 631 | −0.41 | 1121 | 77.2 |
| Comparative Example 5 | Air | 200000 | 2.870 | 812 | 305 | −0.53 | 918 | 74.0 |

TABLE 4

| | Third transport step | | Permanent magnet | | | | | |
|---|---|---|---|---|---|---|---|---|
| | | | Interval between | Coercivity | Coercivity | Temperature coefficient of | Residual magnetic | Squareness ratio |
| | Gas | Oxygen concentration | R-rich phases | [23° C.] | [150° C.] | coercivity | flux density | [23° C.] |
| | — | Mass ppm | $i_{AVE}$ μm | HcJ kA/m | HcJ kA/m | β %/° C. | Br mT | Hk/HcJ % |
| Example 1 | Ar | 20 | 5.576 | 1677 | 892 | −0.36 | 1204 | 88.5 |
| Example 3 | Ar | 2000 | 5.414 | 1740 | 927 | −0.37 | 1189 | 88.7 |
| Example 2 | Air | 200000 | 5.586 | 1738 | 864 | −0.36 | 1144 | 92.2 |

TABLE 5

| | Ribbon production step | | | | | | Permanent magnet |
|---|---|---|---|---|---|---|---|
| | Nozzle | | Chamber | | | Ejection | Interval between |
| | Gas | Pressure | Gas | | | differential | R-rich phases |
| | — | kPa | — | $H_2$ concentration (mass %) | Pressure kPa | pressure kPa | $i_{AVE}$ μm |
| Example 1 | Ar | 100 | Ar | 0.00% | 60 | 40 | 5.576 |
| Example 4 | Ar | 100 | Ar | 0.10% | 60 | 40 | 8.680 |
| Example 5 | Ar | 100 | Ar | 0.20% | 60 | 40 | 8.168 |
| Example 6 | Ar | 100 | Ar | 0.50% | 60 | 40 | 7.912 |

| | Permanent magnet | | | | |
|---|---|---|---|---|---|
| | Coercivity [23° C.] HcJ kA/m | Coercivity [150° C.] HcJ kA/m | Temperature coefficient of coercivity β %/° C. | Residual magnetic flux density Br mT | Squareness ratio [23° C.] Hk/HcJ % |
| Example 1 | 1677 | 892 | −0.36 | 1204 | 88.5 |
| Example 4 | 2001 | 1256 | −0.29 | 1439 | 88.8 |
| Example 5 | 2142 | 1095 | −0.38 | 1455 | 92.3 |
| Example 6 | 1968 | 1177 | −0.32 | 1364 | 85.9 |

TABLE 6

| | Ribbon production step | | | | | | Permanent magnet |
|---|---|---|---|---|---|---|---|
| | Nozzle | | Chamber Gas | | | Ejection differential pressure | Interval between R-rich phases |
| | Gas — | Pressure kPa | — | $H_2$ concentration (mass %) | Pressure kPa | kPa | $i_{AVE}$ μm |
| Comparative Example 10 | Ar | 60 | Ar | 0.10% | 20 | 40 | 3.870 |
| Example 4 | Ar | 100 | Ar | 0.10% | 60 | 40 | 8.680 |
| Example 7 | Ar | 140 | Ar | 0.10% | 100 | 40 | 8.680 |
| Example 8 | Ar | 180 | Ar | 0.10% | 140 | 40 | 7.915 |

| | Permanent magnet | | | | |
|---|---|---|---|---|---|
| | Coercivity [23° C.] HcJ kA/m | Coercivity [150° C.] HcJ kA/m | Temperature coefficient of coercivity β %/° C. | Residual magnetic flux density Br mT | Squareness ratio [23° C.] Hk/HcJ % |
| Comparative Example 10 | 1383 | 562 | −0.47 | 1296 | 76.4 |
| Example 4 | 2001 | 1256 | −0.29 | 1439 | 88.8 |
| Example 7 | 2001 | 1256 | −0.29 | 1439 | 88.8 |
| Example 8 | 1967 | 1192 | −0.31 | 1462 | 94.1 |

TABLE 7

| | First transport step | | Permanent magnet | | | | | |
|---|---|---|---|---|---|---|---|---|
| | Gas — | Oxygen concentration Mass ppm | Interval between R-rich phases $i_{AVE}$ μm | Coercivity [23° C.] HcJ kA/m | Coercivity [150° C.] HcJ kA/m | Temperature coefficient of coercivity β %/° C. | Residual magnetic flux density Br mT | Squareness ratio [23° C.] Hk/HcJ % |
| Example 4 | Ar | 20 | 8.680 | 2001 | 1256 | −0.29 | 1439 | 88.8 |
| Comparative Example 11 | Ar | 2000 | 4.931 | 1548 | 852 | −0.35 | 1219 | 79.4 |
| Comparative Example 12 | Air | 200000 | 2.901 | 1019 | 399 | −0.48 | 1012 | 64.2 |

TABLE 8

| | Second transport step | | Permanent magnet | | | | | |
|---|---|---|---|---|---|---|---|---|
| | Gas — | Oxygen concentration Mass ppm | Interval between R-rich phases $i_{AVE}$ μm | Coercivity [23° C.] HcJ kA/m | Coercivity [150° C.] HcJ kA/m | Temperature coefficient of coercivity β %/° C. | Residual magnetic flux density Br mT | Squareness ratio [23° C.] Hk/HcJ % |
| Example 4 | Ar | 20 | 8.680 | 2001 | 1256 | −0.29 | 1439 | 88.8 |
| Comparative Example 13 | Ar | 2000 | 4.213 | 1347 | 666 | −0.40 | 1249 | 69.2 |
| Comparative Example 14 | Air | 200000 | 2.903 | 966 | 303 | −0.54 | 996 | 64.5 |

TABLE 9

| | Third transport step | | Permanent magnet | | | | | |
|---|---|---|---|---|---|---|---|---|
| | Gas | Oxygen concentration | Interval between R-rich phases $i_{AVE}$ | Coercivity [23° C.] HcJ | Coercivity [150° C.] HcJ | Temperature coefficient of coercivity β | Residual magnetic flux density Br | Squareness ratio [23° C.] Hk/HcJ |
| | — | Mass ppm | μm | kA/m | kA/m | %/° C. | mT | % |
| Example 4 | Ar | 20 | 8.680 | 2001 | 1256 | −0.29 | 1439 | 88.8 |
| Example 9 | Ar | 2000 | 8.281 | 2075 | 1266 | −0.31 | 1420 | 86.1 |
| Example 10 | Air | 200000 | 8.419 | 2179 | 1225 | −0.34 | 1421 | 85.3 |

TABLE 10

| | Composition of raw material metal (molten metal) (mass %) | | | | | | | | | Permanent magnet Interval between R-rich phases $i_{AVE}$ |
|---|---|---|---|---|---|---|---|---|---|---|
| | Nd | Pr | Dy | Tb | Fe | Co | Ga | Al | B | μm |
| Example 4 | 30.17 | 0.00 | 0.00 | 0.00 | bal. | 3.96 | 0.59 | 0.04 | 0.97 | 8.680 |
| Example 11 | 10.65 | 17.40 | 2.07 | 0.00 | bal. | 3.40 | 0.50 | 0.07 | 0.97 | 9.217 |

| | Permanent magnet | | | | |
|---|---|---|---|---|---|
| | Coercivity [23° C.] HcJ kA/m | Coercivity [150° C.] HcJ kA/m | Temperature coefficient of coercivity β %/° C. | Residual magnetic flux density Br mT | Squareness ratio [23° C.] Hk/HcJ % |
| Example 4 | 2001 | 1256 | −0.29 | 1439 | 88.8 |
| Example 11 | 2459 | 1376 | −0.35 | 1445 | 87.9 |

TABLE 11

| | Grain boundary diffusion step Composition of diffusing material (mass %) | | | Permanent magnet | | | | | |
|---|---|---|---|---|---|---|---|---|---|
| | Nd | Tb | Cu | Interval between R-rich phases $i_{AVE}$ | Coercivity [23° C.] HcJ | Coercivity [150° C.] HcJ | Temperature coefficient of coercivity β | Residual magnetic flux density Br | Squareness ratio [23° C.] Hk/HcJ |
| | | | | μm | kA/m | kA/m | %/° C. | mT | % |
| Example 4 | 66 | 24 | 10 | 8.680 | 2001 | 1256 | −0.29 | 1439 | 88.8 |
| Example 12 | 0 | 100 | 0 | 8.850 | 1889 | 1275 | −0.26 | 1421 | 87.6 |

INDUSTRIAL APPLICABILITY

For example, the R-T-B based permanent magnet according to one aspect of the present invention is suitable as a material for a motor equipped in electric vehicles or hybrid vehicles.

REFERENCE SIGNS LIST

2: R-T-B based permanent magnet, 2*cs*: cross section of permanent magnet, 4: main phase grain (primary grain), 4*a*: secondary grain, 6: R-rich phase, C: easy magnetization axis direction.

What is claimed is:

1. An R-T-B based permanent magnet comprising:

a rare earth element R;

a transition metal element T; and

B, wherein the R-T-B based permanent magnet includes at least Nd as R, the R-T-B based permanent magnet includes at least Fe as T, the R-T-B based permanent magnet contains a plurality of main phase grains and a plurality of R-rich phases, the plurality of main phase grains include at least R, T, and B, the plurality of R-rich phases include at least R, the plurality of main phase grains observed in a cross section of the R-T-B based permanent magnet are flat, the cross section is substantially parallel to an easy magnetization axis direction of the R-T-B based permanent magnet, each of the plurality of R-rich phases is located between the plurality of main phase grains, and an average value of intervals between the plurality of R-rich phases in the easy magnetization axis direction is from 5 μm to a width of the R-T-B based permanent magnet in the easy magnetization axis direction.

2. The R-T-B based permanent magnet according to claim 1, wherein an average value of lengths of short axes of the plurality of main phase grains observed in the cross section is from 20 nm to 200 nm.

3. The R-T-B based permanent magnet according to claim 1, wherein a content of R is from 28 mass % to 33 mass %, and a content of B is from 0.8 mass % to 1.1 mass %.

4. The R-T-B based permanent magnet according to claim 1, wherein at least a part of the plurality of R-rich phases includes R-oxides.

5. The R-T-B based permanent magnet according to claim 1, wherein the plurality of main phase grains that are flat are stacked along the easy magnetization axis direction.

6. The R-T-B based permanent magnet according to claim 1, wherein the R-T-B based permanent magnet is a hot deformed magnet.

7. The R-T-B based permanent magnet according to claim 1, wherein a concentration of R in at least a part of the plurality of R-rich phases is higher than an average value of a concentration of R in the cross section, and a unit of the concentration of R is atom %.

8. The R-T-B based permanent magnet according to claim 1, wherein a concentration of R in at least a part of the plurality of R-rich phases is higher than a concentration of R in the plurality of main phase grains, and a unit of the concentration of R is atom %.

* * * * *